United States Patent [19]

Nara et al.

[11] Patent Number: 5,007,095

[45] Date of Patent: Apr. 9, 1991

[54] SYSTEM FOR SYNTHESIZING SPEECH HAVING FLUCTUATION

[75] Inventors: Yasuhiro Nara, Chigasaki; Tatsuro Matsumoto, Kawasaki, both of Japan

[73] Assignee: Fujitsu Limited, Kawasaki, Japan

[21] Appl. No.: 462,295

[22] Filed: Dec. 29, 1989

Related U.S. Application Data

[63] Continuation of Ser. No. 170,255, Mar. 18, 1988, abandoned.

[30] Foreign Application Priority Data

Mar. 18, 1987 [JP] Japan ..... 62-061149

[51] Int. Cl.[5] ..... G10L 5/00

[52] U.S. Cl. ..... 381/51

[58] Field of Search ..... 364/513.5, 714.17; 381/51-53

[56] References Cited

U.S. PATENT DOCUMENTS

| | | | |
|---|---|---|---|
| 4,128,737 | 12/1978 | Dorais | 381/53 |
| 4,228,517 | 10/1980 | Constant | 364/724.17 |
| 4,264,783 | 4/1981 | Gagnon | 381/53 |
| 4,278,838 | 7/1981 | Antonov | 381/52 |
| 4,433,210 | 2/1984 | Ostrowski et al. | 381/53 |
| 4,653,099 | 3/1987 | Kanke et al. | 381/51 |

FOREIGN PATENT DOCUMENTS

| | | |
|---|---|---|
| 55-133099 | 10/1980 | Japan . |
| 56-60499 | 5/1981 | Japan . |
| 58-186800 | 10/1983 | Japan . |

OTHER PUBLICATIONS

Wiggins et al., "Three-Chip System Synthesizes Human Speech", *Electronics*, Aug. 31, 1978, pp. 109-116.

The Journal of the Acoustical Society of Japan, vol. 34, No. 3, Mar. 1978, "Formulation of the Process of Coarticulation in Terms of Formant Frequencies and its Application to Automatic Speech Recognition", by Sato et al., pp. 177-185 (A partial translation from Sato and Fujisaki).

J. Acoust. Soc. Am. 67(3), Mar. 1980, "Software for a Cascade/Parallel Formant Synthesizer", by Klatt, pp. 971-994.

*Primary Examiner*—Dale M. Shaw
*Assistant Examiner*—David D. Knepper
*Attorney, Agent, or Firm*—Staas & Halsey

[57] ABSTRACT

A system for synthesizing speech having improved naturalness and formed by a simple construction. The speech synthesizing system includes a unit for generating a vowel signal, a unit for generating a consonant signal including a unit for generating random data, a unit connected to the random data generating unit for receiving the random data therefrom, and having a first-order delaying function $1/(s\tau+\alpha)$. The unit having a first-order delay for receiving the random data outputs first-order delayed random data. A unit for selecting the vowel signal or the consonant signal in response to a selection signal and a unit for receiving an output signal from the selection unit and filtering the received signal on the basis of a vocal tract simulation method are also provided. The first-order delayed random data from the first-order delaying unit are substantially applied to the vowel signal and/or the consonant signal.

22 Claims, 18 Drawing Sheets

SYSTEM FOR SYNTHESIZING SPEECH HAVING FLUCTUATION

This is a continuation of copending application Ser No. 07/170,255, filed on Mar. 18, 1988, now abandoned.

BACKGROUND OF THE INVENTION

1. Field of the Invention

The present invention relates to a systematic speech synthesizing system. More particularly, the present invention is directed to a digital speech synthesizing system which synthesizes speech which is stable and very natural and a speech synthesizing system which performs parameter interpolation during the synthesis of speech by a simply constructed critical damping two-order filter to smooth the parameter connection and thus produce natural sounding synthesized speech.

The speech synthesizing apparatus of the present invention may be used, for example, on an output apparatus for outputting things such as speech keyboard input sentences to confirm the keyboard input, typing machines for the blind, and voice answering machines using telephones.

2. Description of the Related Art

In speech Synthesis, the output sound should be as close as possible to the human voice, i.e., speech that is as natural as possible. One type of speech synthesis is systematic speech synthesis. In such speech synthesis, speech is synthesized using pulses for vowels and random numbers for consonants. In human speech, however, the voice is modulated, i.e., the voice fluctuates. For example, when stretching the vowel "ah" to "ahhh", the amplitude of the speech waveform, the pitch, frequency, etc., do not remain completely constant, but are modulated (or fluctuated). Even when changing to another sound, the apparatus, pitch, etc. do not undergo a smooth change, but are modulated. For this reason, when synthesizing speed, if the amplitude, pitch, and other parameters are kept constant at steady portions of speech and the apparatus, pitch, and other parameters smoothly change at the nonsteady portions, only a mechanical, monotonous speech can be obtained. Therefore, in the prior art, attempts have been made to modulate the output of speech synthesizers to produce very natural sounding synthesized speech.

On the other hand, when synthesizing speech, conversion occurs by inputting sentences→converting to sound codes→preparing synthesis parameters→outputting speech. When synthesizing speech for an arbitrary sentence, the parameters are linked in accordance with predetermined rules, waiting with each synthesis unit smaller than a single sentence, for example, speech elements or syllables, so as to form a time series of parameters. If a suitable linkage is not performed, noise occurs in the synthesized speech and the natural characteristic of the synthesized speech is lost. Therefore, the parameters of the individual speech synthesis units must be smoothly changed as in actual speech. Thus, a method for an interpolation of parameters is proposed.

All of the prior art, however, suffer from the problem that stable, very natural, modulated speech synthesis cannot be achieved. This prior art will later be explained in further detail with reference to the drawings. Further, the construction of the filters used for speech synthesis requires simplication.

SUMMARY OF THE INVENTION

An object of the present invention is the provision of a speech synthesis apparatus able to output a stable, very natural, modulated speech.

Another object of the present invention is the provision of a speech synthesis apparatus having a simple construction.

According to the present invention, there is provided a speech synthesizing system including a unit for generating a vowel signal, a unit for generating a consonant signal and having a unit for generating random data, a unit operatively connected to the random data generation unit to receive the random data therefrom and having a first-order delaying function $(1/(s\tau+\alpha))$, for outputting first-order delayed random data, a unit for selecting the vowel signal or the consonant signal in response to a selection signal, and a unit for receiving an output signal from the selection unit and filtering the received signal on the basis of a vocal tract simulation method. The first-order delayed random data from the first-order delaying unit is substantially applied to the vowel signal and/or the consonant signal.

The first-order delaying unit may include an adding unit, an integral unit connected to the adding unit to receive an output from the adding unit, and a negative feedback unit provided between an output terminal of the integral unit and an input terminal of the adding unit, for multiplying the output from the integral unit and a coefficient $(\alpha)$ and inverting the sign of the multiplied value. The adding unit adds the random data from the random data generation unit and the inverted-multiplied value from the negative feedback unit.

The integral unit of the first-order delaying unit may include a multiplying unit, an adding unit, a data holding unit and a feedback line unit provided between an output terminal of the data holding unit and an input terminal of the adding unit. The multiplying unit multiplies the output from the adding unit of the first-order delaying unit and a factor $(1/\tau)$, where $\tau$ is a time constant. The adding unit in the integral unit adds the output from the multiplying unit and the output from the data holding unit through the feedback line unit. The coefficient $\alpha$ may be one.

The vowel signal generating unit and the consonant signal generating unit may include a common parameter interpolating unit for receiving a first signal having a sound frequency, a second signal having a sound amplitude and a third signal having a silent amplitude, and interpolating the received first to third signals to output first to third interpolated signals.

The vowel signal generating unit may include a unit for generating an impulse train signal in response to the first interpolated signal, and a unit for multiplying the impulse train signal and the second interpolated signal to supply a first multiplied signal to the selection unit. The consonant signal generating unit may further include a unit for multiplying the random data output from the random data generation unit therein and the third interpolated signal to supply a second multiplied signal to the selection unit. The vowel signal generating unit may include a unit for adding a constant as a bias and the first-order delayed random data from the first-order delaying unit, and a unit for multiplying an added signal from the adding unit and the output from the vocal tract simulation filtering unit to output a speech signal having fluctuation components added thereto.

A speech synthesizing system may further include a unit for adding a constant as a bias to the first-order delayed random data from the first-order delaying unit. The vowel signal generating unit may include a first multiplying unit multiplying the first interpolated signal and the added signal from the adding unit, a unit for generating an impulse train signal in response to the multiplied signal from the first multiplying unit, a second multiplying unit for multiplying the second interpolated signal and the added signal from the adding unit, and a third multiplying unit for multiplying the impulse train signal and the second multiplied signal from the second multiplying unit to supply the multiplied signal to the selection unit. The consonant signal generating unit may further include a fourth multiplying unit for multiplying the added signal from the adding unit and the third interpolated signal, and a fifth multiplying unit for multiplying the random data signal from the random data generating unit therein and the fifth multiplied signal from the fifth multiplying unit to supply the fifth multiplied signal to the selection unit.

The vowel signal generating unit may include a first adding unit for adding the first interpolated signal and the first-order delayed signal from the first-order delaying unit, a unit for generating an impulse train signal in response to the first added signal from the first adding unit, a second adding unit for adding the second interpolated signal and the first-order delayed signal, and a first multiplying unit for multiplying the impulse train signal and the second added signal from the second adding unit to output the first multiplied signal to the selection unit. The consonant signal generating unit may further include a third adding unit for adding the third interpolated signal and the first-order delayed signal, and a second multiplying unit for multiplying the random data from the random data generating unit therein and the third added signal from the third adding unit to output the second multiplied signal to the selection unit.

The common parameter interpolating unit may include a linear interpolating unit. Or, the common parameter interpolating unit may include a series-connected first data holding unit, a critical damping two-order filtering unit and a second data holding unit.

The critical damping two-order filtering unit may include series-connected first and second adder units, series-connected first and second integral units, a first multiplying unit provided between an output terminal of the first integral unit and an input terminal of the second adder unit, for multiplying the output of the first integral unit and a damping factor DF and inverting a sign of the multiplied value, and a second multiplying unit provided between an output terminal of the second integral unit and an input terminal of the first adding unit, for multiplying an output from the second integral unit and a coefficient, and inverting a sign of the multiplied value. The first adding unit adds an output from the first data holding unit in the common parameter interpolating unit and the inverted multiplied value from the second multiplying unit. The second adding unit adds an output from the first adding unit and the inverted multiplied value from the first multiplying unit.

Each of the first and second integral units may include a multiplying unit, an adding unit, a data holding unit and a feedback line unit provided between an output terminal of the data holding unit and an input terminal of the adding unit. The multiplying unit multiplies the input and a factor $1/\tau$, where $\tau$ is a time constant. The adding unit adds the output from the multiplying unit and the output from the data holding unit through the feedback line unit. The damping factor DF may be two, and the coefficient may be one.

The critical damping two-order filtering unit may include series-connected first and second first-order delaying units, each including an adding unit, an integral unit and a multiplying unit provided between an output terminal of the integral unit and an input terminal of the adding unit, for multiplying an output of the integral unit and a coefficient and inverting the same. The adding unit adds an input and the inverted-multiplied value from the multiplying unit and supplies an added value to the integral unit.

The integral unit may include a multiplying unit, an adding unit, a data holding unit and a feedback line unit provided between an output terminal of the data holding unit and an input terminal of the adding unit. The multiplying means multiplies the input and a factor $1/\tau$, where $\tau$ is a time constant. The adding unit adds an output from the adding unit and the output from the data holding unit through the feedback line unit.

According to the present invention, there is also provided a speech synthesizing system including a parameter interpolating unit, an impulse train generating unit, a random data generating unit for generating random data, a selection unit, a first multiplying unit connected between an output terminal of the impulse train generating unit and an input terminal of the selection unit, a second multiplying unit connected between an output terminal of the random data generation unit and another input terminal of the selection unit, and a unit for filtering an output from the selection unit on the basis of a vocal tract simulation method. The parameter interpolating unit may include a critical damping two-order filtering unit for receiving the random data from the random data generating unit, and for interpolating a first signal having a sound frequency, a second signal having a sound amplitude and a third signal having a silent amplitude by multiplying the random data of the first to third signals and by filtering the first to third multiplied data on the basis of a critical damping two-order filtering method. First to third interpolated signals are then output. The impulse train generating unit generates impulse trains in response to the first interpolated signal. The first multiplying unit multiplies the impulse trains and the second interpolated signal to output a vowel signal to the input terminal of the selection unit. The second multiplying unit multiplies the random data and the third interpolated signal. A consonant signal is output to another input terminal of the selection unit. The selection unit selects the vowel signal or the consonant signal in response to a selection signal, and outputs a selected signal to the vocal tract simulation filtering unit.

The critical damping two-order unit in the parameter interpolating unit may include a first multiplying unit for multiplying the input and a first coefficient A, a first adding unit connected to the first multiplying unit, a second adding unit connected to the first adding unit, a first integral unit connected to the second adding unit, and a second multiplying unit connected between an output terminal of the first integral unit and an input terminal of the second adding unit, for multiplying an output of the first integral unit and a second coefficient B and outputting the same to the second adding unit. A second integral unit is connected to the output terminal of the first integral unit, and a third multiplying unit is provided between an output terminal of the second integral unit and an input terminal of the first adding unit for multiplying an output from the second integral unit and a third coefficient C. The first adding unit adds an output from the first multiplying unit and an output from the third multiplying unit. The second adding unit adds an output from the first adding unit and an output from the second multiplying unit, to output the interpolated signals.

BRIEF DESCRIPTION OF THE DRAWINGS

Other objects and features of the present invention will be described below in detail with reference to the accompanying drawings, in which.

DESCRIPTION OF THE PREFERRED EMBODIMENTS

Before describing the preferred embodiments of the present invention, examples of prior art will be described for comparison.

Figure 1:
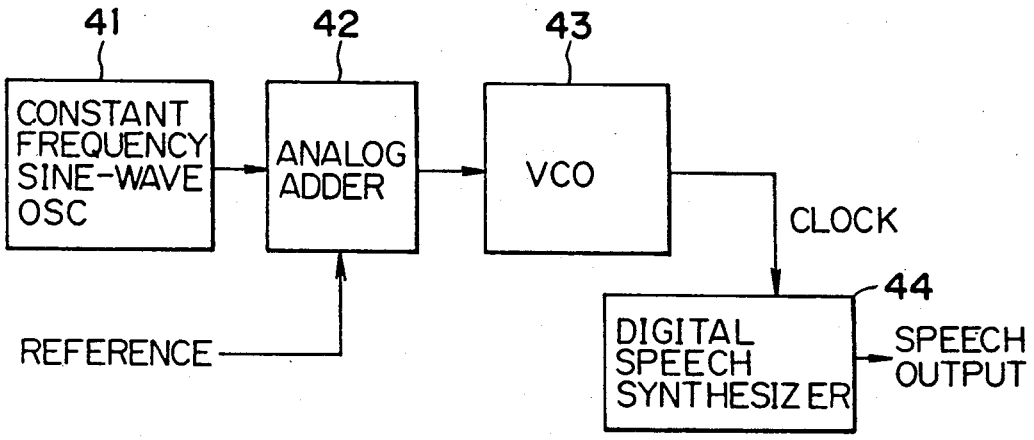
Fig. 1 PRIOR ART
FIG. 1 is a prior art modulated speech synthesis apparatus.

FIG. 1 is a prior art speech synthesis apparatus for modulating a speech output.

IN FIG. 1, a constant frequency sine wave oscillator 41 outputs a sine wave of a constant frequency. An analog adder 42 adds a positive reference (bias) to the output of the constant frequency sine wave oscillator 41 and outputs a variable amplitude signal with an amplitude changing to the positive side. A voltage controlled oscillator 43 receives the variable amplitude signal from the analog adder 42 and generates a clock signal CLOCK with a frequency corresponding to the change in amplitude and supplies the same to a digital speech synthesizer 44. The digital speech synthesizer 44 is a speech synthesizer of the full digital type which uses a clock signal having a changing frequency as the standardization signal and generates and outputs synthesized speech with a modulated frequency component.

In the speech synthesizer of FIG. 1, the modulation (fluctuation) is effected through a simple sine wave, so some mechanical unnatural sound still remains. Also, the modulation is made to only the standardized frequency, and is not include in the amplitude component of the synthesized speech.

Figure 2:
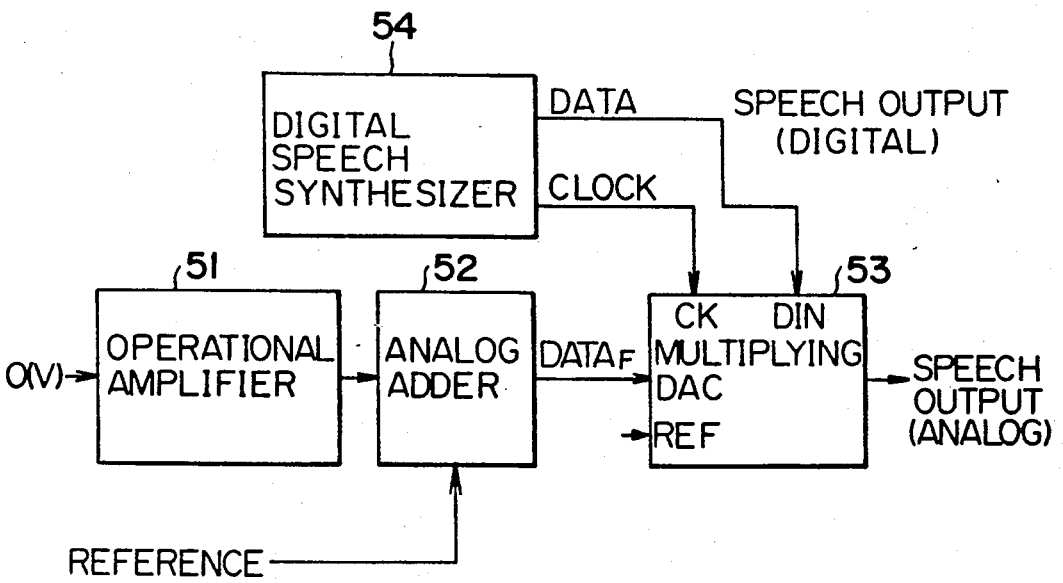
Fig. 2 PRIOR ART
FIG. 2 is another prior art modulated speech synthesis apparatus.

FIG. 2 is another conventional speech synthesis apparatus for modulating the speech output. When a direct current of 0 volts is input to the operational amplifier 51, which has an extremely large amplification rate of, for example, over 10,000, the output does not completely become a direct current of 0 volts but is modulated due to the drift of the operational amplifier. The apparatus of FIG. 2 utilizes the drift. The modulation signal produced in this way is an analog signal of various small positive and negative values. The operational amplifier 51 generates the modulation signal and adds it to the analog adder 52. The analog adder 52 adds a positive reference (bias) to the input modulation signal to generate a modulated amplitude signal $DATA_f$ having a changing amplitude at the positive side and inputs the same to the reference voltage terminal REF of the multiplying digital-to-analog converter 53. On the other hand, the digital speech synthesizer 54 inputs the digital data DATA and clock CLOCK of the speech synthesized by the digital method to the DIN terminal and CK terminal of the multiplying digital-to-analog converter 53. The multiplying digital-to-analog converter 53 multiplies a value of the digital data DATA input from the DIN terminal and a value of the modulated amplitude signal (voltage) input from the REF terminal and outputs an analog voltage as a speech output corresponding to the product of DATA$_f$X DATA. Accordingly, an analog speech signal with a modulated amplitude is obtained. There is the advantage in that this modulation is close to the modulation of natural speech. Note that in this speech synthesis method, only the amplitude of the output is modulated, i.e., the frequency component is not modulated, but it is possible to modulate the frequency component as well. For example, it is possible to use an analog type speech synthesizer as a speech synthesizer and add a modulation signal to the parameters for controlling the frequency characteristics (expressed by voltage) so as to realize a modulated frequency component. Further, when using a digital type speech synthesizer, it is possible to convert the modulation signal to digital form by a digital-to-analog converter and add the same to a digital expression speech synthesizer.

The speech synthesizer of FIG. 2 has the advantage of outputting speech with a modulated sound close to natural speech, but conversely the modulation is achieved by an analog-like means, so the magnitude of the modulation differs depending on the individual differences of the operational amplifier 51. A problem arises in that it is impossible to achieve the same characteristics. Further, the problem of aging accompanied with instability arises, resulting in changes in the modulation characteristics.

Next, the conventional parameter interpolation method in speech synthesizers will be explained with reference to FIG. 3 and FIG. 4.

Figure 3:
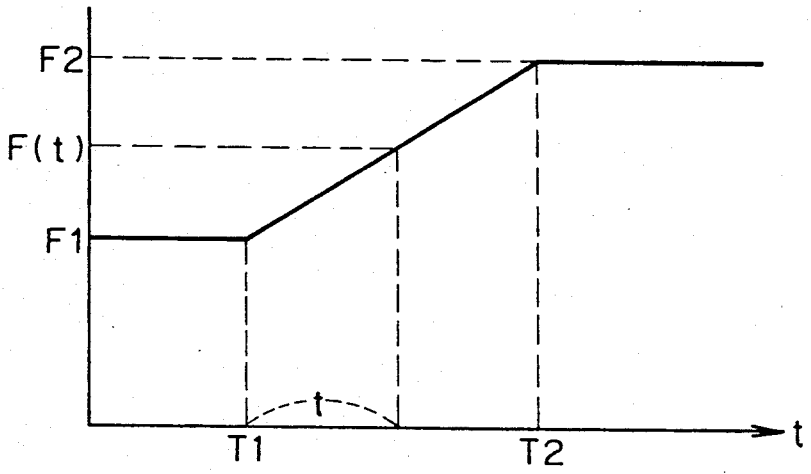
Fig. 3 PRIOR ART
FIG. 3 is a diagram of the linear interpolation method of parameters in a conventional speech synthesis system.

FIG. 3 is a graph of a parameter interpolation method of the linear interpolation type. In the linear interpolation method, if the parameters of time T1 and T2 are respectively F1 and F2, interpolation is performed for linearly changing the parameters between the time T1 to time T2. If the parameter during the period t from the time T1 to the time T2 is F(t), F(t) is given by the following equation (1):

$$F(t)=(F2-F1)(t-T1)/(T2-T1)+F1 \quad (1)$$

where, $T1 \leqq t \leqq T2$

The linear interpolation method enables interpolation of parameters by simple calculations. On the other hand the characteristics of change of the parameters are exhibited by polygonal lines, and thus differ from the actual smooth change of the parameters, denoting that a synthesis of natural speech is not possible.

Figure 4:
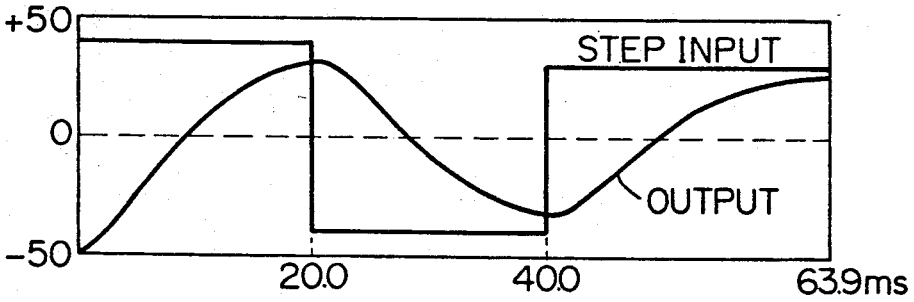
Fig. 4 PRIOR ART
FIG. 4 is a diagram of the output characteristics of the parameter interpolation method using a conventional critical damping two-order filter.

As a parameter interpolation method which eliminates the defects of the linear interpolation method and enables a smooth connection of parameters, there is the method which utilizes a critical damping two-order filter shown in FIG. 4. That is, this method inputs commands to the next target value as step-wise changes of the parameters, smoothes the step-wise changes, and outputs a linear signal which is approximated by the critical damping two-order filer. Accordingly, the changes in parameters are performed smoothy, as illustrated.

The transfer function HC(s) and step response S(t) of the critical damping two-order filer are given by the following equations (2) and (3):

$$Hc(s)=\omega^2/(s^2+2\omega s+\omega^2) \quad (2)$$

$$S(t)=1-(1+\omega t)\exp(-\omega t) \quad (3)$$

where, $\omega=1/\tau$($\tau$: time constant)

Here, when the parameter at the time $t_1$ is $F_1$ and commands are given to the target valuves $F_2, F_3, \ldots, F_m$ at the times $t_2, t_3, \ldots t_m$, the input C(t) to the critical damping two-order filter and the response f(t) of the system to the input C(t) are given by the following equations (4) and (5) (for example, see *The Journal of the Acoustical Society of Japan,* Vol. 34, No. 3, p.p. 177 to 185):

$$c(t) = F_1 + \sum_{j=2}^{m} (F_j - F_{j-i})u(t - t_j) \quad (4)$$

$$f(t) = F_1 + \sum_{j=1}^{m} (F_j - F_{j-1})u(t - t_j) \cdot [1 - \{1 + \omega(t - t_j)\}\exp\{-\omega(t - t_j)\}] \quad (5)$$

Here, $t \geqq t_j$, u is the unit step function, and the value of 0 is taken when $t-t_j<0$ and the value of 1 is taken when $t-t_j \geqq 0$.

Figure 5:
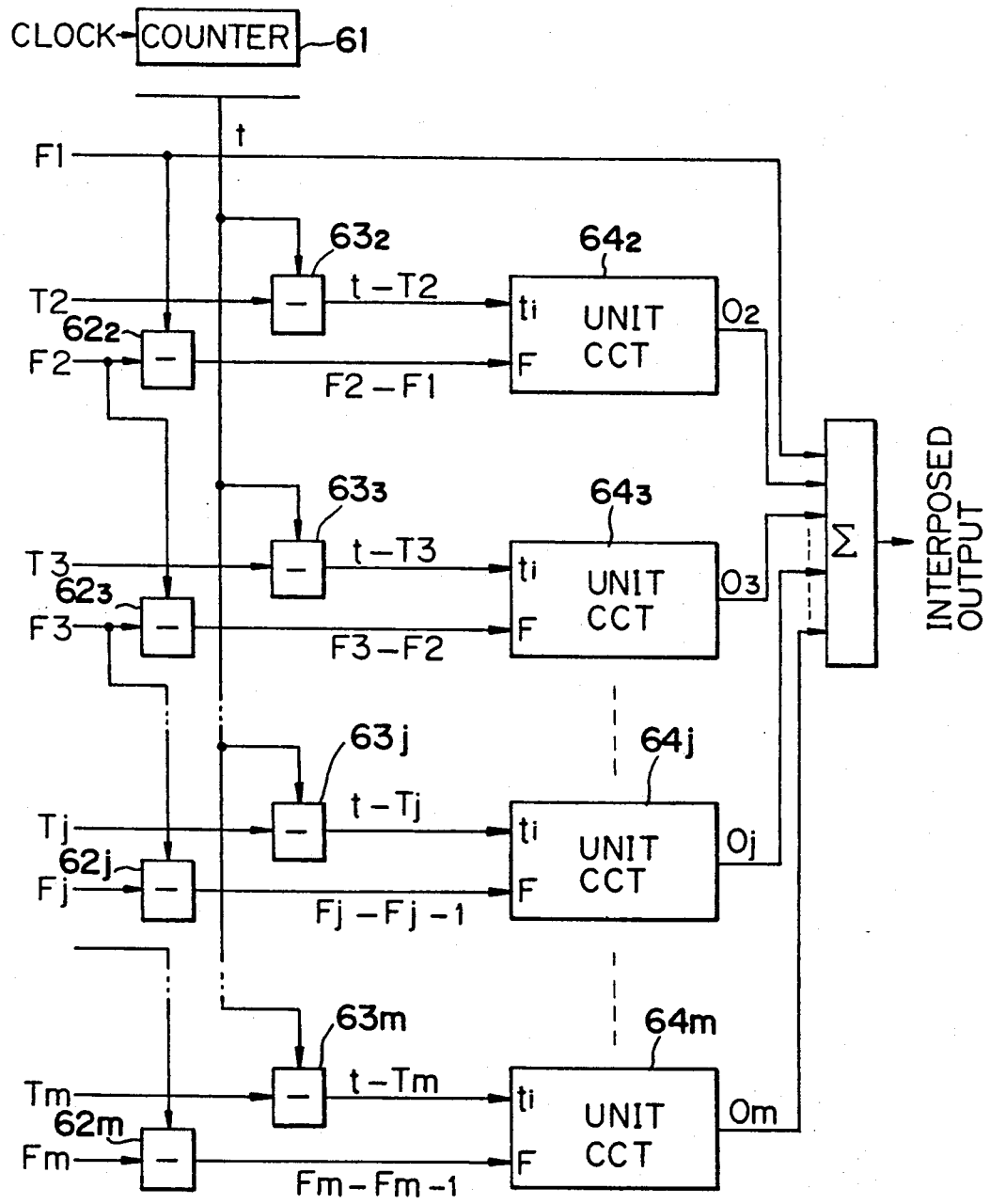
Fig. 5 PRIOR ART
FIG. 5 is a prior art critical damping two-order filter.

FIG. 5 shows a critical damping two-order filter which achieves the response f(t) of equation (5). In FIG. 5, 61 is a counter which counts the time t. Reference number $62_j$(j=2 to m) is a subtractor, which calculates $F_j-F_{j-1}$(j=2 to m). Reference numeral $63_j$ (j=2 to m) is also a subtractor which calculates $t-T_j$ (j=2 to m). Reference numeral $64_j$ (j=2 to m) is a unit circuit, which performs the operation of the following equation (6) and generates the output $O_j$ (j=2 to m):

$$O_j=(F_j-F_{j-1})u(t-t_j)\cdot[1-\{1+\omega(t-t_j)\}\cdot\exp\{-\omega(t-t_j)\}] \quad (6)$$

The content of equation (6) is the same as the content of the term in Σ of equation (5). Reference numeral 65 is an adder, which adds the output $O_j$ and $F_1$ of the unit circuits $64_j$ (j=2 to m) to generate an interpolation output, i.e., the response f(tP of equation (5).

The fact that the response f(t) of equation (5) can be obtained by the construction of FIG. 5 is clear from the fact that the output $O_j$ of the unit circuit of equation (6) shows the value of the terms in the Σ of equation (5). By using such a critical damping two-order filter, since the speed at the starting point is O, the target value $F_j$ is gradually approached nonvibrationally and the parameters can be connected smoothly, the actual state of change of speech parameters is approached and speech synthesis can be obtained having a superior natural sound compared even with linear interpolation.

However, the method of parameter transfer using a critical damping two-order filter has the problems that the construction of the filter for achieving critical two-order damping is complicated and the amount of calculation involved is great, so the practicality is poor. For example, when there are (m−1) target values, each time the time passes a command time ($t_2, t_3, \ldots, t_m$), the number of calculations of an exponential part increases until finally (m−1) number of calculations of the exponential part are required, so the amount of calculation becomes extremely great.

Figure 6:
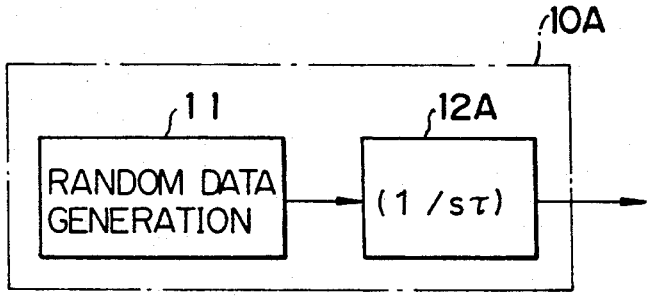
Fig. 6 PRIOR ART
FIG. 6 is a diagram of how modulation is produced in the prior art.

Another conventional speech synthesizer will be explained with reference to FIG. 6. FIG. 6 shows in a block diagram the construction of the speech synthesizer disclosed in Japanese Patent Application No. 58-186800.

In the figure, reference numeral 10A is a means for producing a modulation (fluctuation) time series signal consisting of a random number time series generator 11 and integration filter 12A. The random data generator 11 generates a time series of random numbers, for example, uniform random numbers, and successively outputs the random number time series at equal time intervals. The integration filter 12A is a digital type integration filter and consists of an integrator 31 with a transfer function of $1/s\tau$, where $\tau$ is a time constant with a magnitude experimentally determined so as to give highly natural, modulated synthesized speech. Note that $\omega=1/\tau$. Below, the explanation will be made using $\tau$ instead of $\omega$. The random number time series produced by the random number time series generator 11 is filtered by the integration filter 12A and a modulation time series signal is output.

Figure 7:
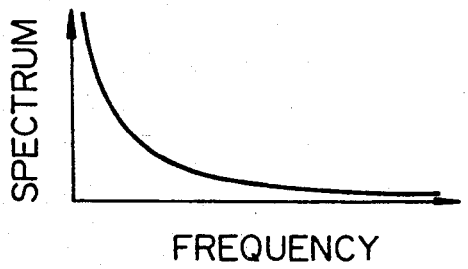
Fig. 7 PRIOR ART
FIG. 7 is a graph of the spectrum characteristics of a modulation time series signal produced by the modulation method of FIG. 6.

FIG. 7 shows an outline of the spectrum of a modulation time series signal produced by a modulation time series signal generator means 101, which takes the form of a hyperbola. The figure assumes the case of the random number time series generator 11 outputting uniform random numbers (white noise), that is, the case of a flat spectrum of the random number time series. When the spectrum of the random number time series is not flat, the spectrum ends up multiplied with the spectrum of FIG. 7. In either case, the spectrum takes a form close to 1/f (where f is frequency). This reflects the phenomenon that the modulation of the movement of the human body has characteristics close to 1/f. This enables a synthesis of highly natural speech.

Figure 8:
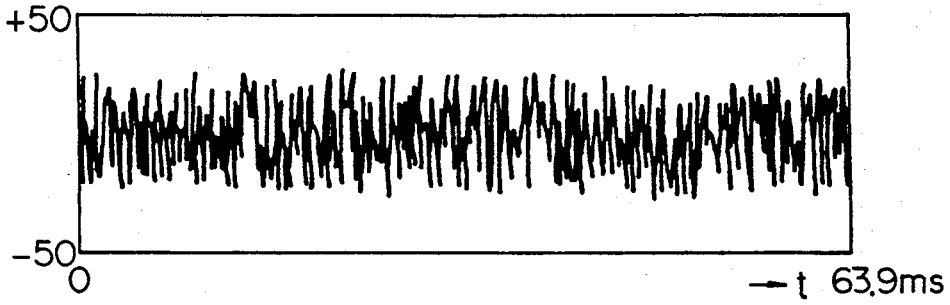
Fig. 8 PRIOR ART
FIG. 8 is a conventional random data signal waveform chart.

FIG. 8 is an example of a waveform of uniform random numbers within a range of −25 to +25.

Figure 9:
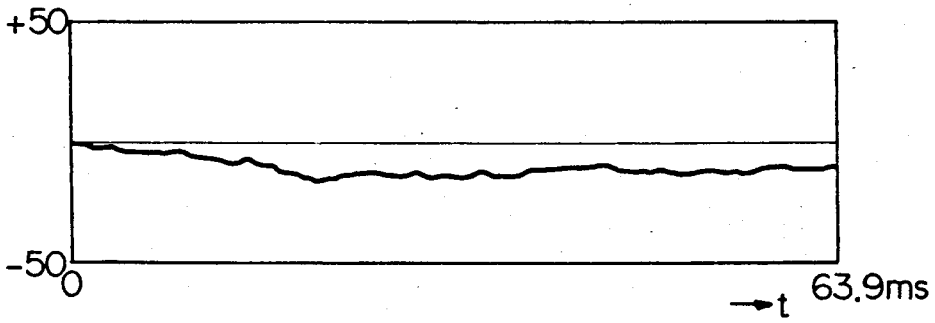
Fig. 9 PRIOR ART
FIG. 9 is a waveform chart of a modulation time series signal produced by the modulation method of the prior art.

FIG. 9 is an example of a modulation time series signal produced by integration filtering the uniform random numbers shown in FIG. 8 by the integration filter 12. The time constant in this case is 32. In this way, it is possible to produce a desired modulation time series signal using a simple circuit.

However, the spectrum characteristics of a modulation time series signal produced by the afore-mentioned modulation method are limitless when the frequency f is 0, as shown in FIG. 7. Therefore, if even a slight direct current component is included in the random number time series produced by the random under time series generator 11, the direct current component will be modified and the mean value of the output (modulation time series signal) will become larger and larger. However, random numbers produced by the digital method are not complete random numbers but in general have a period. Therefore, there is periodicity where, if more than a certain number of random numbers are produced, the same random number series will be repeated, and thus there is no guarantee that the sum will be zero in the general random number generation method. In the graph of the modulation time series signal shown in FIG. 9, the state of the direct current component when multiplied and superposed is shown. If an attempt is made to make the sum of the random number time series exactly zero, the connection of the random number time series generator 11 would be complicated. That is, the aforementioned modulation method has a simple construction, but suffers from the problem of multiplication of the direct current component.

Below, an explanation will be given by a speech synthesizer using the modulation method based on the present invention, which solves the problems of the conventional modulation methods described with reference to FIG. 6 to FIG. 9 and which achieves a mean value of the modulation time series signal of zero, i.e., a direct current component of zero. Further, a description will be made of an embodiment of the present invention having a simple construction which realizes the critical damping two-order filter used for the speech synthesizer of the present invention.

Figure 10:
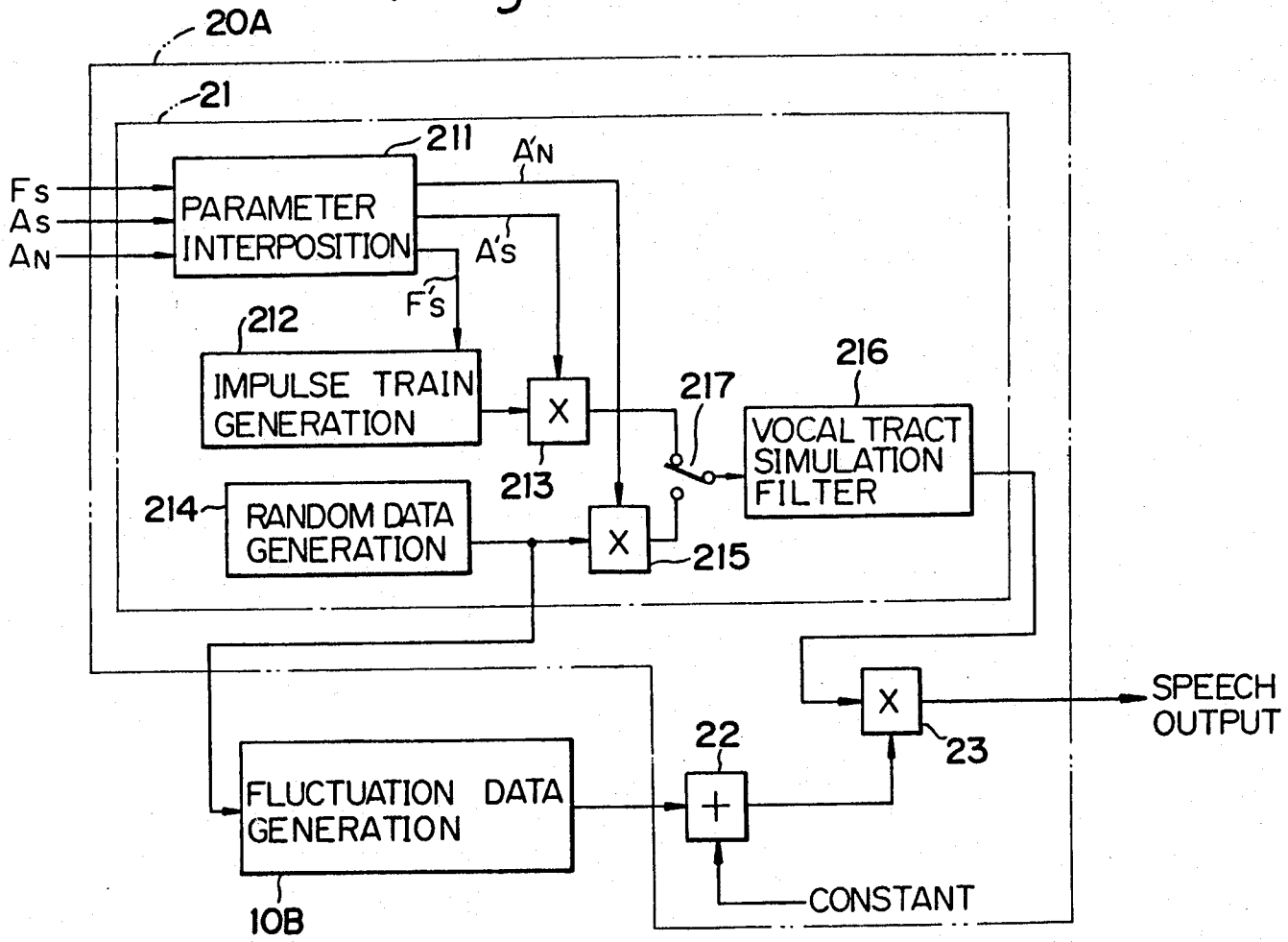
FIG. 10 is a speech synthesis apparatus according to the first embodiment of the present invention.

FIG. 10 is a speech synthesizer of a first embodiment of the present invention. The speech synthesizer of FIG. 10 is comprised of a speech synthesis means 20A and a modulation time series signal data generator 10B.

First, a description will be given, with reference to FIG. 11, on the modulation (fluctuation) generation means 10B of the present invention which solves the problem in conventional modulation generation means.

Figure 11:
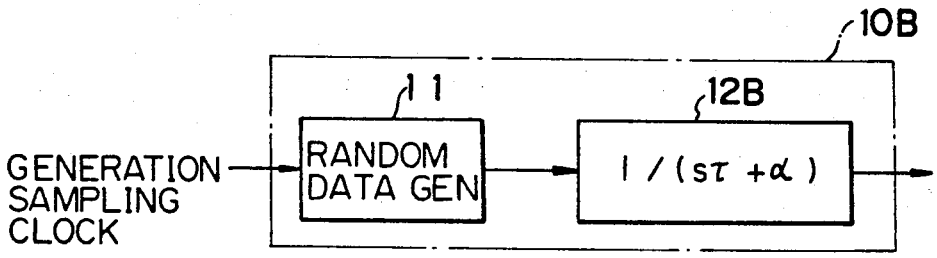
FIG. 11 is a diagram of a modulation method used in the present invention.

In FIG. 11, reference numeral 10B is a modulation (fluctuation) time series signal generation means which is comprised of a random number time series generator 11 and an integration filter 12B.

The random number time series generator 11, like in the prior art, generates time series data of random numbers, for example, uniform random numbers, and sequentially outputs the random number time series data at equal time intervals based on a sampling clock. The random number time series data is generated by various known methods. For example, by multiplying the output value at a certain point of time by a large constant and then adding another constant, it is possible to obtain the output of another point of time. In this case, overflow is ignored. Another method is to shift the output value at a certain point of time by one bit at the higher bit side or lower bit side and to apply the one bit value obtained by an EXCLUSIVE OR connection of several predetermined bits of the value before the shift to be undefined bit of the lowermost or uppermost bit formed by the shift (known as the M series). The modulation time series signal data generated in this way is random number time series data, and therefore, avoids mechanical unnaturalness.

The integration filter 12B is comprised of a first-order delay filter having a transfer function of $1/(s\tau+\alpha)$. By subjecting the random number time series data generated by the random number time series generator 11 to first-order delay filtering by the integration filter 12B, modulation time series signal data is produced.

Figure 12:
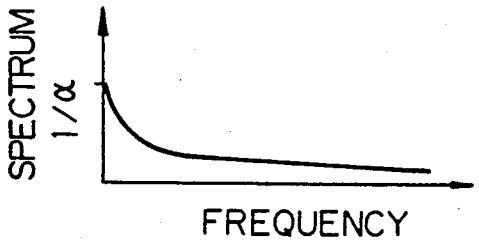
FIG. 12 is a graph of the spectrum characteristics of a modulation time series signal produced by the modulation method of FIG. 11.

FIG. 12 shows the spectrum characteristics of the transfer function $1/s\tau+\alpha)$, that is, the spectrum characteristics of the modulation time series signal data produced when the spectrum of the random number time series data is flat. As shown in FIG. 12, the spectrum of the first-order delay filter is a finite value of $1/\alpha$ at a direct current (f=0), so even if a direct current component is included in the random number time series data it will no longer accumulate, as shown in FIG. 9.

Figure 13:
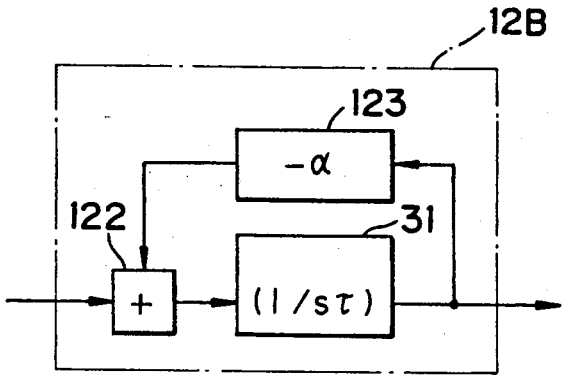
FIG. 13 is a diagram of a first-order delay filter used in the modulation method of FIG. 11.
Figure 14:
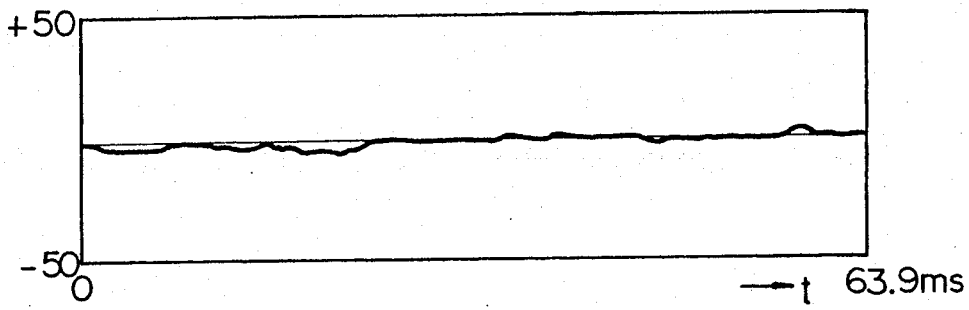
FIG. 14 is a waveform chart of a modulation time series signal produced by the modulation method of FIG. 11.

FIG. 13 is a block diagram of a first-order delay filter 12B. Reference numeral 31 is an integrator with a transfer function of 1/s, 122 is an adder, and 123 is a negative feedback unit for negative feedback of the coefficient $\alpha$. The integrator 31 has the same construction as the integrator 12A of FIG. 6. By this construction, a first-order delay filter with a transfer function of $1/(s\tau+\alpha)$ is realized. Here, $\alpha$ is determined experimentally, but if $-\alpha=-1$ is selected, then the negative feedback is realized by simple code conversion of the output (for example, compliment of 2), so a simple construction first-order delay filter can be used to make the sum of the modulation time series signal data, that is, the sum a of the direct current component, zero. FIG. 14 is an example of modulation time series signal data produced by the modulation method of FIG. 11 in the case of a first-order delay filter of $-\alpha-=1$, , wherein the time constant $\tau$ is 32. By subjecting the random number time series data to first-order delay filtering, as shown in FIG. 14, the mean value of the modulation time series signal becomes zero. It is possible to eliminate the phenomenon of separation of the mean value from zero along with time, as in the prior art.

Figure 15:
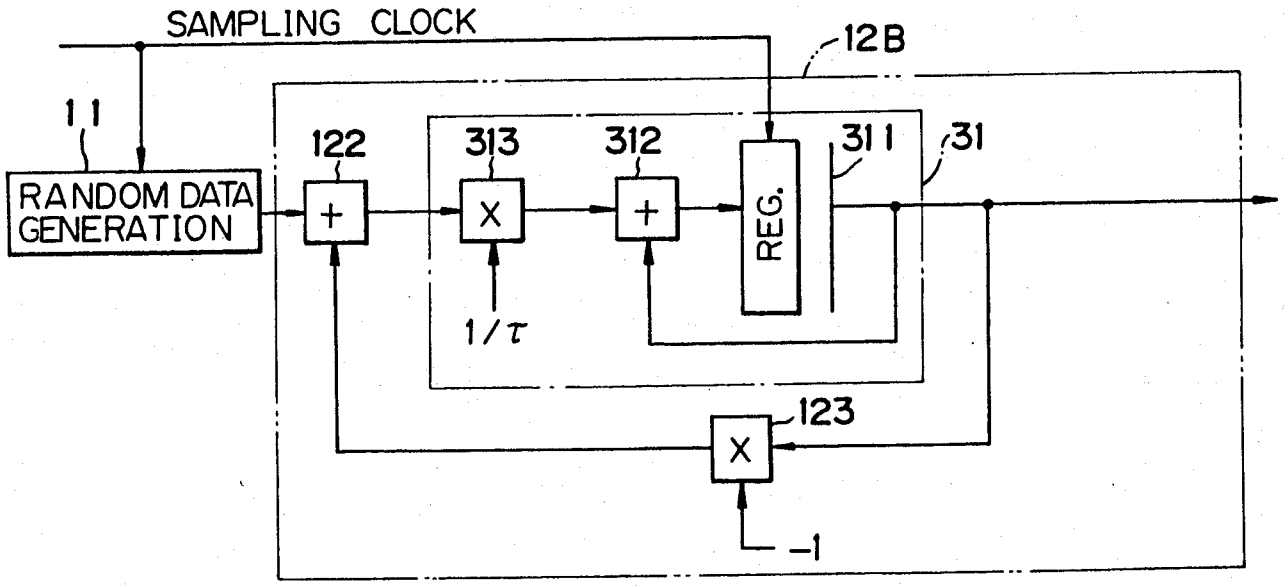
FIG. 15 is a diagram of a first-order delay filter in FIG. 11.

FIG. 15 is a first-order delay filter 12B constructed in this way. Reference numeral 122 is an adder, and 123 is a multiplier which multiplies the output of the integrator 31 by the constant "−1" and adds the result to the adder 122.

Based on the modulation time series signal produced by the modulation method of the present invention, explained above, the speech synthesis means synthesis modulated speech. The modulation (fluctuation) incorporation processing for giving modulation to speech is performed by various methods. Below, an explanation is given for various modulation incorporation methods performed by the speech synthesis means.

A first modulation incorporation method will be explained with reference to FIG. 10. The speech synthesis means 20A has a speech synthesizer 21. Reference numeral 211 is a parameter interpolator which comprises the speech synthesizer 21. This inputs a parameter with every frame period of 5 to 10 msec or with every event change or occurrence such as a change of sound element, performs parameter interpolation processing, and outputs an interpolated parameter every sampling period of 100 microseconds or so. In general, there are many types of parameters used by speech synthesis apparatuses, but FIG. 10 shows just those related to modulation incorporation processing. Fs is the basic frequency of voiced sound (s: source), As is the amplitude of the sound source in voiced sound, and An is the amplitude of the sound source in voiceless sound (n: noise). Further, F's, A's and A'n are parameters interpolated by the parameter interpolator 211. Reference numeral 212 is an impulse train generator which generates an impulse train serving as the sound source of the voiced sound. The output is frequency controlled by the parameter F's and, further, is amplitude controlled by multiplication with the parameter A's by the multiplier 213 to generate a voiced sound source waveform. Reference numeral 214 is a random number time series signal generator which produces noise serving as the sound source for the voiceless sounds. The output is controlled in amplitude by multiplication by the parameter A'n in the multiplier 215 to generate the voiceless sound source waveform. Reference numeral 216 is a vocal tract characteristic simulation filter which simulates the sound transmission characteristics of the windpipe, mouth, and other parts of the vocal tract. It receives as input voiced or voiceless sound source waveforms from the impulse train generator 212 and random number time series signal generator 21 through a switch 217 and changes the internal parameters (not shown) to synthesize speech. For example, by slowly changing the parameters, vowels are formed and by quickly changing them, consonants are formed. The switch 217 switches the voiced and voiceless sound sources and is controlled by one of the parameters (not shown).

The speech synthesizer 21 formed by 211 to 217 explained above has the same construction as the conventional speech synthesizer and has no modulation function. The speech synthesizer 21, in the same way as the prior art, synthesizes nonmodulated speech and outputs digital synthesized speech by the vocal tract characteristic filter 216.

Reference numeral 22 is an adder which adds a positive constant with a fixed positive level to a modulation time series signal input from a modulation time series signal generation means 10B. That is, the modulation time series signal changes from positive to negative within a fixed level, but the addition of a positive constant as a bias produces a modulation time series signal with a modulation in level in the positive direction. The ratio between the modulation level of the modulation time series signal and the level of the positive constant is experimentally determined, but in this embodiment the ratio is selected to be 0.1.

Reference numeral 23 is a multiplier which multiplies the digital synthesized speech, i.e., the output time series of the speech synthesizer 21, with the modulation time series signal input from the adder 22. Thus, digital synthesized speech modulated in amplitude is produced. This digital synthesized speech is converted to normal analog speech signals by a digital to analog converter (not shown) and further sent via an amplifier to a speaker (both not shown) to produce modulated sound.

Note that the random number time series generator 11 in the modulation time series signal generator means 10B and the random number time series generator 214 in the speech synthesizing means 20 produce random number time series of the same content and thus the two can be replaced by a single unit. This enables further simplication of the construction of the speech synthesis apparatus. FIG. 10 is a circuit wherein the random number time series generator 214 of the speech synthesis means 20 is used for the random number time series generator 11 of the modulation time series signal generation means 10B. The same thing applies in the other modulation incorporation methods.

Figure 16:
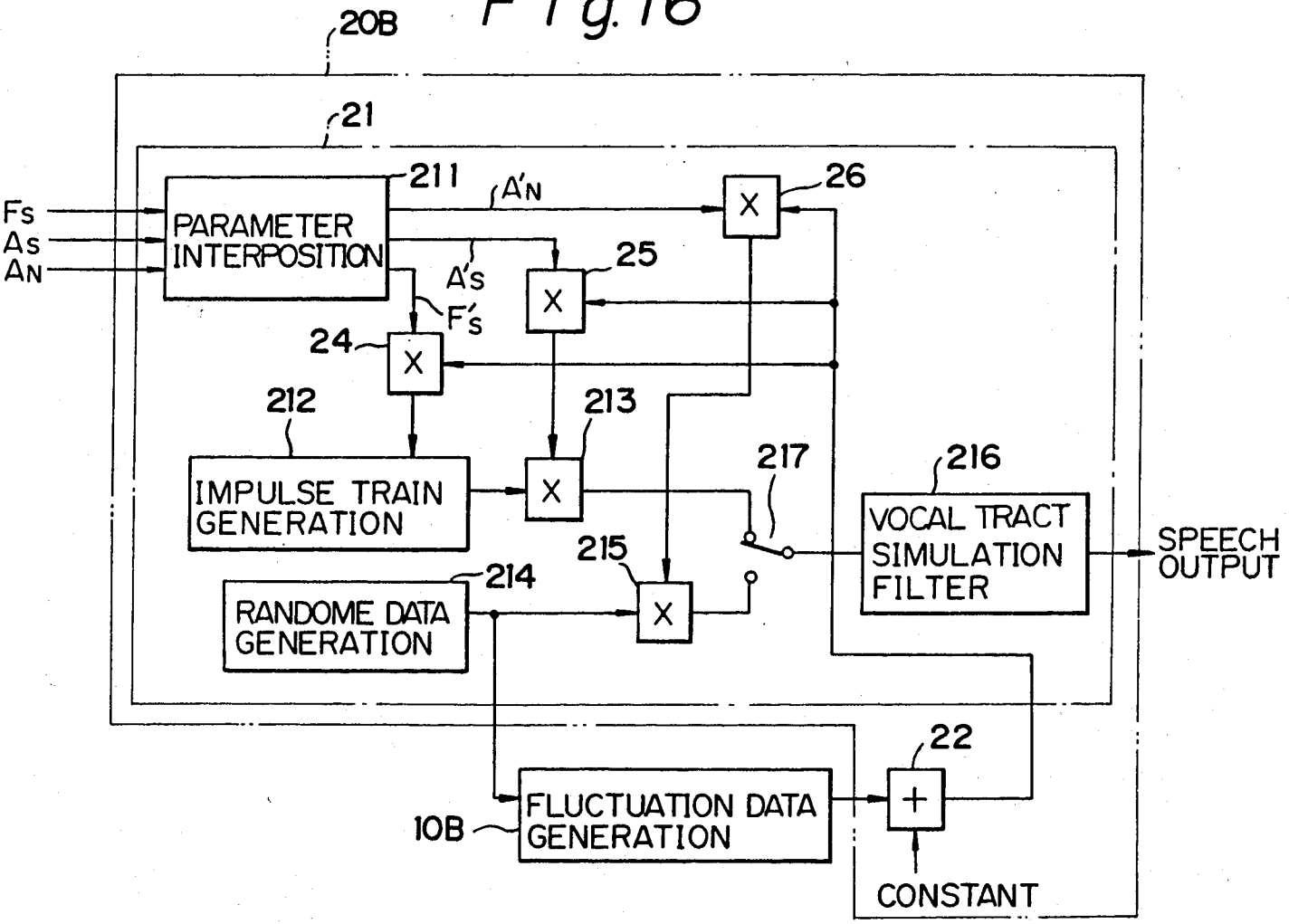
FIG. 16 is a diagram of a speech synthesis apparatus according to a second embodiment of the present invention.

Referring to FIG. 16, an explanation will be given with respect to a second modulation incorporation method.

The first modulation (fluctuation) incorporation method modulated the amplitude of the output time series signal of the speech synthesizer, but the second modulation incorporation method modulates the time series parameter used in the speech synthesis means 20B so as to synthesizes speech modulated in both the amplitude and frequency.

In FIG. 16, the modulation time series signal generator means 10B and, in the speech synthesis means 20B, the speech synthesizer 21, the parameter interpolator 211 provided in the speech synthesizer 21, the impulse train generator 212, the random number time series generator 214, the multipliers 213 and 215, the vocal tract characteristic simulation filter 216, the switch 217, and the adder 22 have the same construction as those in FIG. 10.

In the speech synthesis means 20B, reference numerals 24, 25 and 26 are elements newly provided for the second modulation incorporation method. Since these circuits are formed integrally with the speech synthesizer 21, they are illustrated inside the speech synthesizer 21.

The multiplier 24 multiplies the parameter F's input from the parameter interpolator 211 with the modulation time series signal input from the adder 22 to modulate the parameter F's Therefore, the impulse time series of the voiced sound source output by the impulse train signal generator 212 is frequency modulated. The multiplier 25 multiplies the parameter A's input from the parameter interpolator 211 with the modulation time series signal input from the adder 22. Therefore, the voiced sound source waveform output from the multiplier 213 is frequency and amplitude modulated.

The multiplier 26 multiplies the parameter A'n input from the parameter interpolator 211 with the modulation time series signal input from the adder 22 to modulate the parameter A'n. Therefore, the voiceless sound source waveform output from the multiplier 215 is frequency modulated. The vocal tract characteristic simulation filter 216 receives a voiced sound source waveform frequency and amplitude modulated as an input or receives a voiceless sound source waveform amplitude modulated via a switch 217, changes the internal parameters, and synthesizes the amplitude and frequency modulated speech. The output time series of the speech synthesizer 21 is, in the same way as the case of the first modulation incorporation method, subjected to digital-to-analog conversion, amplified and output as sound from speakers.

In the above method, it is possible to modulate both the amplitude and frequency components and synthesize more natural speech.

Note that as another embodiment of the second modulation incorporation method, it is possible to provide just the multiplier 24 and modulate just the frequency component. It is also possible to provide both the multipliers 25 and 26 and modulate just the amplitude component. Further, by multiplying the parameters (not shown) at the vocal tract characteristic simulation filter 216 with the modulation time series signal from the adder 22, it is possible to provide finer modulation.

Figure 17:
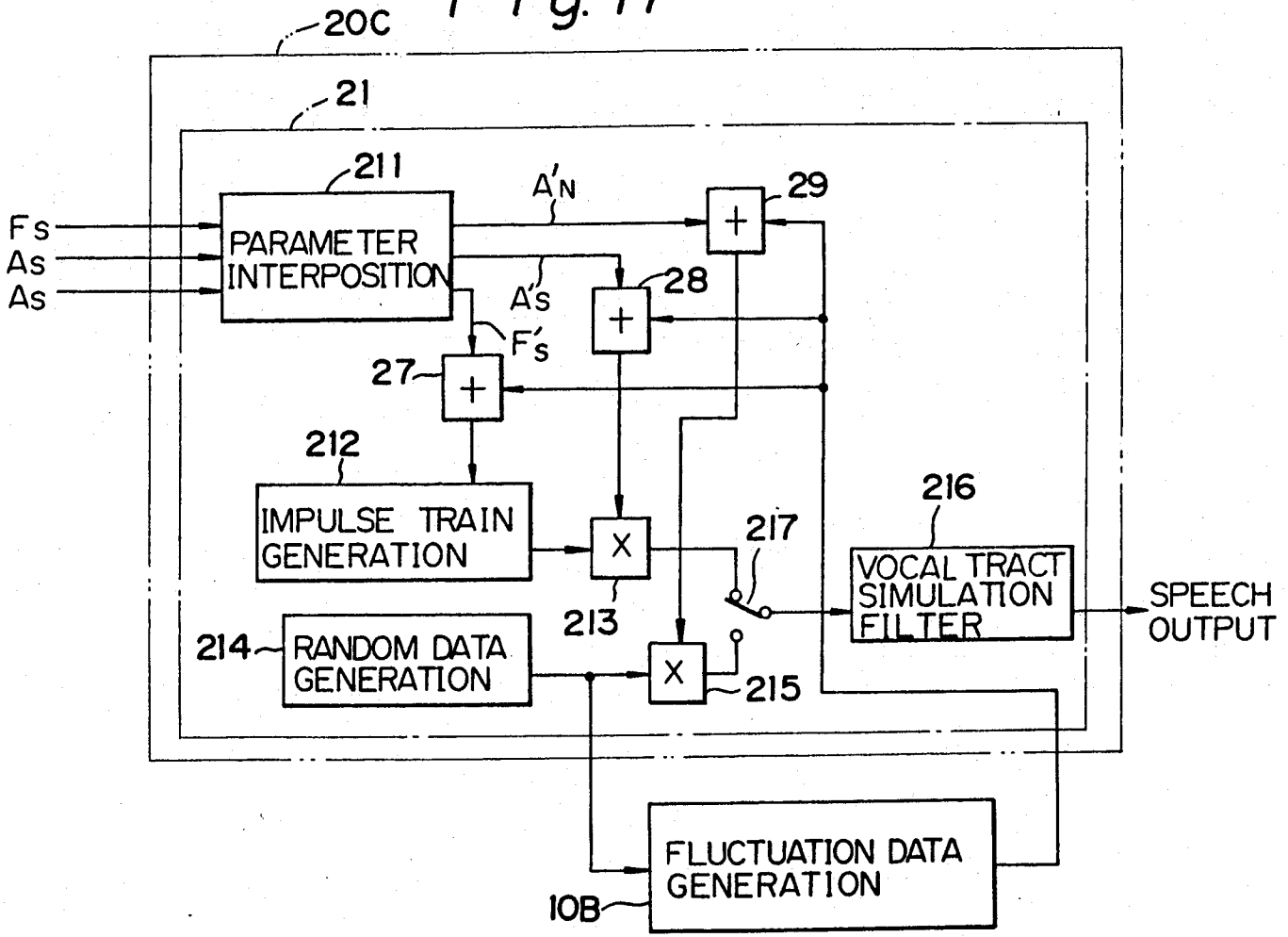
FIG. 17 is a diagram of a speech synthesis apparatus according to a third embodiment of the present invention.

Referring to FIG. 17, an explanation will be given with respect to a third modulation incorporation method.

The third modulation incorporation method, like the second modulation incorporation method, modulates the parameter time series of the speech synthesis means 20C to synthesize modulated speech, but realizes this by a different method.

In FIG. 17, the modulation time series signal generation means 10B and, in the speech synthesis means 20C, the speech synthesizer 21, the parameter interpolator 211 provided in the speech synthesizer 21, the impulse train generator 212, the random number time series generator 214, the multipliers 213 and 215, the vocal tract characteristic simulation filter 216, and the switch 217 have the same construction as those in FIG. 16.

In the third modulation incorporation method, as shown in FIG. 17, the adders 27, 28 and 29 are provided in addition to the multipliers 24, 25 and 26 in the second modulation incorporation method. No provision is made for the adder 22. In this embodiment, the modulation time series signal produced by the modulation time series signal generator means 10B is directly added to the adders 27 to 29.

The adder 27 adds to the parameter F's input from the parameter interpolator 211 the modulation time series signal input from the modulation time series signal generator means 10B to modulate the parameter F's. Therefore, the impulse time series of the voiced sound source output by the impulse train signal generator 212 is frequency modulated. The adder 28 adds to the parameter A's input from the parameter interpolator 211 the modulation time series signal input from the modulation time series signal generator means 10B to modulate the parameter A's. Therefore, the voiced sound source waveform output from the multiplier 213 is frequency and amplitude modulated. The adder 29 adds to the parameter A'n input from the parameter interpolator 211 the modulation time series signal input from the modulation time series signal generator means 10B to modulate the parameter A'n. Therefore, the voiceless sound source waveform output from the multiplier 215 is frequency modulated. The vocal tract characteristic simulation filter 216 receives an amplitude and frequency modulated voiced sound source waveform as an input or receives an amplitude modulated voiceless sound source waveform via a switch 217, changes the internal parameters, and synthesizes amplitude and frequency modulated speech. The time series output of the speech synthesizer 21 is, in the same way as the case of the second modulation incorporation method, subjected to digital-to-analog conversion, amplified, and output as sound from speakers.

In the above method, it is possible to modulate both the amplitude and frequency components and synthesize more natural speech.

Note that as another embodiment of the third modulation incorporation method, in the same way as the second modulation incorporation method, it is possible to provide just the adder 27 and modulate just the frequency component. Further, it is possible to provide both the adders 28 and 29 and modulate just the amplitude component. Further, by adding to the parameters (not shown) at the vocal tract characteristic simulation filter 216 the modulation time series signal from the modulation time series signal generation means 10, it is possible to provide finer modulation.

The parameter interpolator 211 illustrated in FIG. 10, FIG. 16, and FIG. 17 receives input parameters with every frame period of 5 to 10 msec or with every event change or occurrence such as a change of sound element, performs interpolation, and outputs an interpolated parameter every sampling period of 100 microseconds or so. At this time, to smooth (interpolate) the change between parameters, filtering is performed using a critical damping two-order filter, as already explained.

Figure 18:
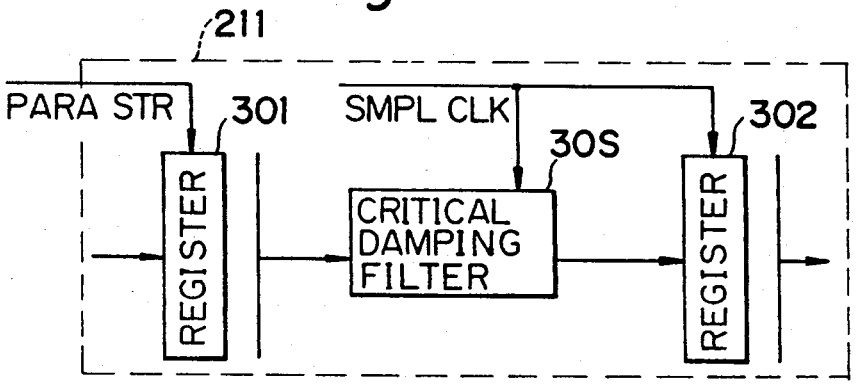
FIG. 18 is a diagram of a parameter interpolation method using a critical damping two-order filter.

FIG. 18 is a circuit for the parameter interpolation method using a critical damping two-order filter in the parameter interpolator 211. In FIG. 18, reference numeral 30S is a critical damping two-order filter and 301 and 302 are registers. The register 301 receives a parameter time series with each event change or occurrence and holds the same. The critical damping two-order filter 30S smoothly connects the changes in parameter values of the register 301 and writes the output into the register 302 with each short interval of about, for example, 100 microseconds. Therefore, the interpolated time series parameter is held in the register 302.

The transfer function H(s) of the critical damping two-order filter 30 for interpolation of the parameter time series is expressed by the afore-mentioned equation (2), i.e., $$H(s)=\omega^2/(s^2+2\omega s+\omega_2)$$

Figure 19:
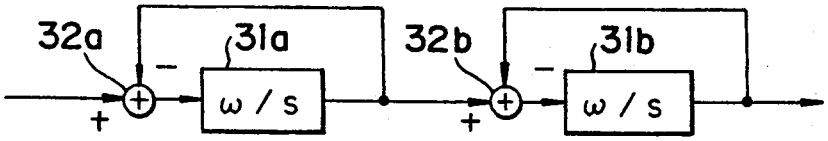
FIG. 19 is a diagram of a critical damping two-order filter of the present invention.

The transfer function H(s) can be formed using the integrator (ω/w). For example, by modifying H(s) to $$H(s)=\{\omega/(s+\omega)\}\cdot\{\omega/(s+\omega)\}$$

it is possible to realize the transfer function by series connection of the primary delay filter of $\omega/(s+\omega)$. Further, the first-order delay filter is realized by the integrator, with a transfer function expressed by $\omega/s$, and negative feedback. Therefore, the critical damping two-order filter 30 may be realized by the control system shown in FIG. 19. In FIG. 19, reference numerals 31*a* and 31*b* are integrators and 32*a* and 32*b* are adders. In this way, the critical damping two-order filter 30 may be realized using the integration filter 31 as a constituent element. The critical damping two-order filter of FIG. 19 approximates the digital integration of the integrator 31 by the simple Euler integration method.

Using the integrator 31 constructed in this way, it is possible to simply realize a critical damping two-order filter 30. Further, it is possible to obtain very natural synthesized speech by smoothly connecting parameters.

There are various methods for constructing the critical damping two-order filter of FIG. 19, but an explanation will be made of the critical damping two-order filters of an embodiment according to the present invention.

A first critical damping two-order filter construction method will be explained with respect to the first method of construction of a critical damping two-order filter with reference to FIG. 20.

The transfer function Hg(s) of the two-order filter is expressed in general by the following formula (7):

$$Hg(s)=(1/(s^2\tau^2+DF\cdot s\tau+1) \quad (7)$$

where, DF is the damping factor Equation (7) may be changed to equation (8):

$$Hg(s)=(1/\{s\tau(s\tau+DF)+1\} \quad (8)$$

The two-order filter with this transfer function is comprised of a first-order delay filter with a transfer function of $1/(s\tau+DF)$, an integrator with a transfer function of $1/s\tau$, and a negative feedback loop with a coefficient of 1. Further, the first-order delay filter with the transfer function of $1/(s\tau+DF)$ includes an integrator with a transfer function of $1/s\tau$ and a negative feedback loop with a coefficient of DF. Therefore, the two-order filter with the transfer function Hg(s) of equation (8) is realized by the circuit in FIG. 20.

Figure 20:
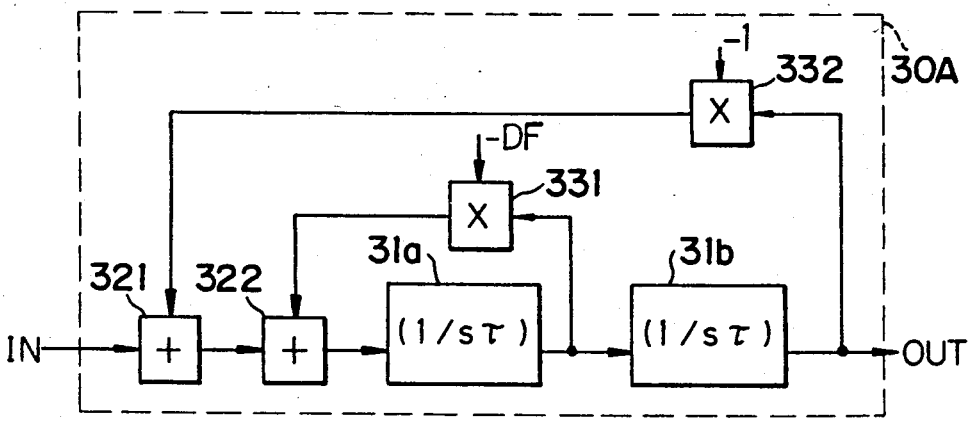
FIG. 20 is a diagram of the critical damping two-order filter according to the present invention.

In FIG. 20, reference numerals 31*a* and 31*b* are integrators with transfer functions of $1/s\tau$, 321 and 322 are adders, and 331 and 332 are multipliers. The adders 321 and 322 and the integrators 31*a* and 31*b* are connected in series. The multiplier 31 multiplies the output of the integrator 31*a* with the coefficient DF and adds the result to the adder 322. The adder 322 multiplies the output of the integrator 31*b* with the coefficient $-1$ and adds the result to the adder 321.

The integrator 31*a*, negative feedback loop of the multiplier 331, and adder 322 form a first-order filter having a transfer function of $DF/(s\tau+DF)$. By connecting the first-order delay filter in series with the integrator 31*b* and supplying the negative feedback having a coefficient $-1$ from the multiplier 332, a two-order filter having a transfer function Hg(s) is formed. The critical damping two-order filter is obtained by selecting DF to be 2.

Figure 21:
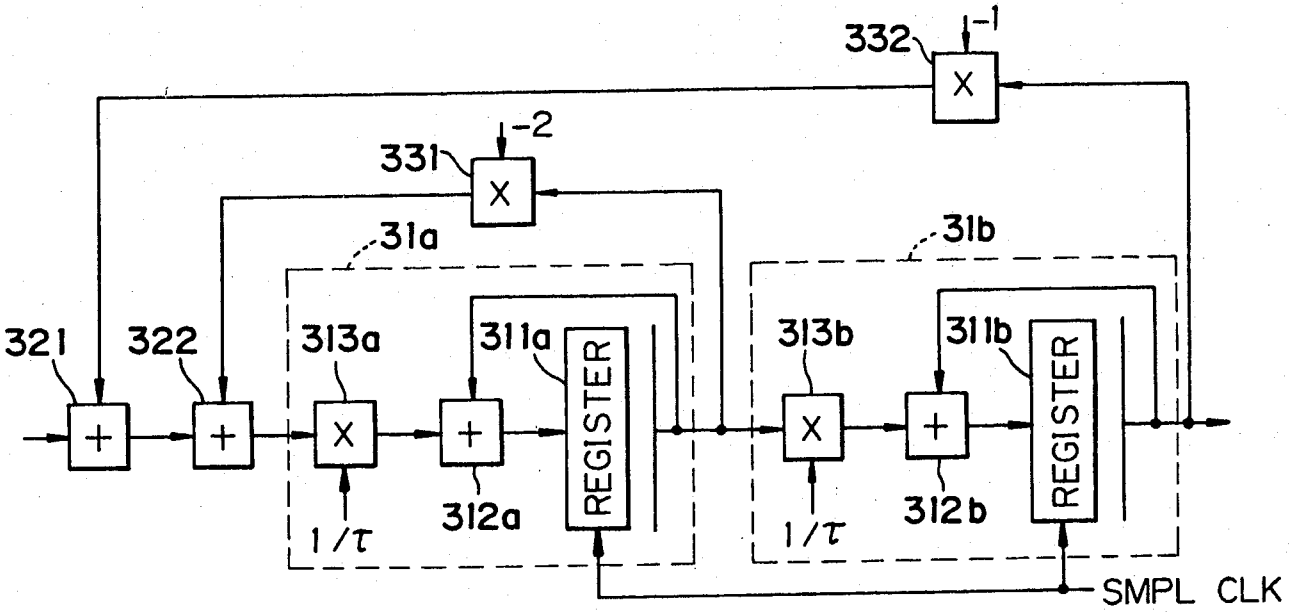
FIG. 21 is a diagram of the critical damping two-order filter in FIG. 20.

FIG. 21 is a critical damping two-order filter. Parts bearing the same reference numerals as in FIG. 20 indicate the same parts. That is, 31*a* and 31*b* are integrators and 311*a* and and 311*b* are registers. Further, 312*a*, 312*b*, 321, and 322 are adders and 313*a*, 313*b*, 331, and 332 are multipliers.

Figure 22A:
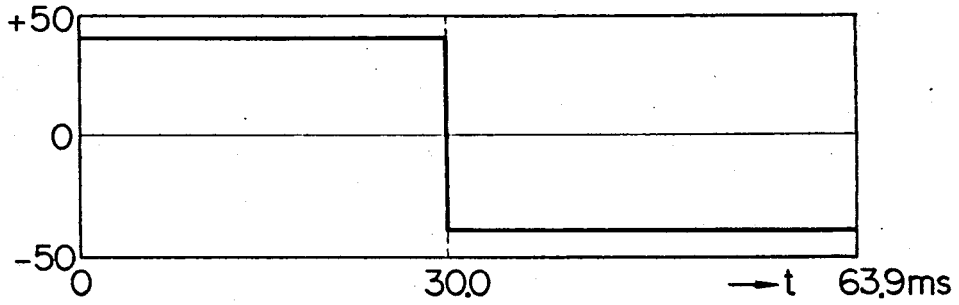
FIGS. 22*a* and 22*b* are graphs of the step response of the critical damping two-order filter of FIG. 21.
Figure 22B:
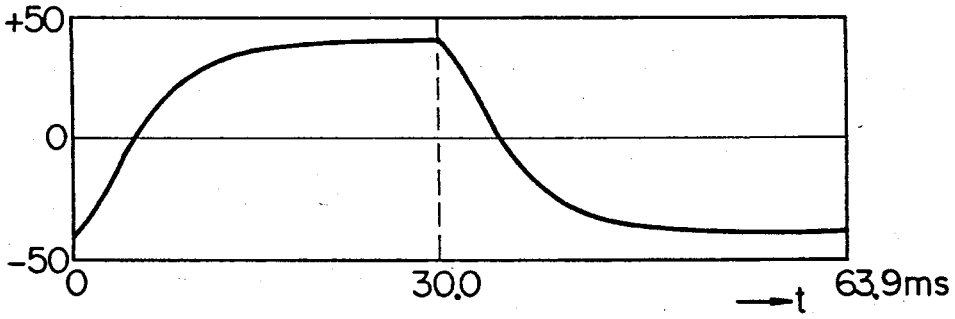

FIGS. 22*a* and 22*b* show the step response characteristics of the critical damping filter of FIG. 21, with FIG. 22*a* showing the step input and FIG. 22*b* the step response characteristics.

An explanation will be given with respect to a second method of construction of a critical damping two-order filter with reference to FIG. 23.

In the case of a critical damping two-order filter, the damping factor DF is 2, so the transfer function Hg(s) changes as in the following equation (9):

$$\begin{aligned} Hc(s) &= 1/(s^2\tau^2 = Ss\tau + 1) = 1/(s\tau + 1)^2 \\ &= 1/\{(s\tau + 1)\} \cdot \{1/(s\tau + 1)\} \end{aligned} \quad (4)$$

Figure 23:
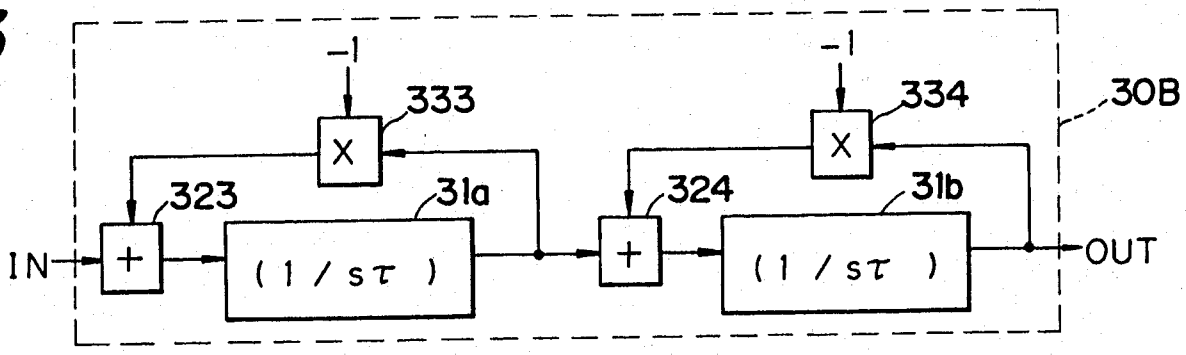
FIG. 23 is a diagram of a critical damping two-order filter according to an embodiment of the present invention.

Therefore, the critical damping two order filter is realized by connecting in series two primary filters having a transfer function of $1/(s\tau+1)$, as shown in FIG. 23.

In FIG. 23, reference numerals 31*a* and 31*b* are integrators having transfer functions of $1/s\tau$ the same as in the case of FIG. 20, 323 and 324 are adders, and 333 and 334 are multipliers. Multiplier 333 multiplies the output of the integrator 31*a* with the coefficient $-1$ and adds the result to the adder 323. The multiplier 334 multiplies the output of the integrator 32 with the coefficient $-1$ and adds the result to the adder 324.

The integrator 31*a*, negative feedback loop of the multiplier 333, and adder 323 form a primary delay filter having a transfer function of $1/(s\tau+1)$. Similarly, the integrator 31*b*, the negative feedback loop of the multiplier 334, and the adder 324 form a primary delay filter having the same transfer function $1/(s\tau+1)$. By connecting in series two primary delay filters, a critical damping two-order filter having a transfer function of $1/(s\tau+1)^2$ is constructed.

The second critical damping two-order filter construction method comprises a two stage series of primary delay filters having the same construction, so construction is simpler and easier than the first critical damping two-order filter construction method.

Figure 24:
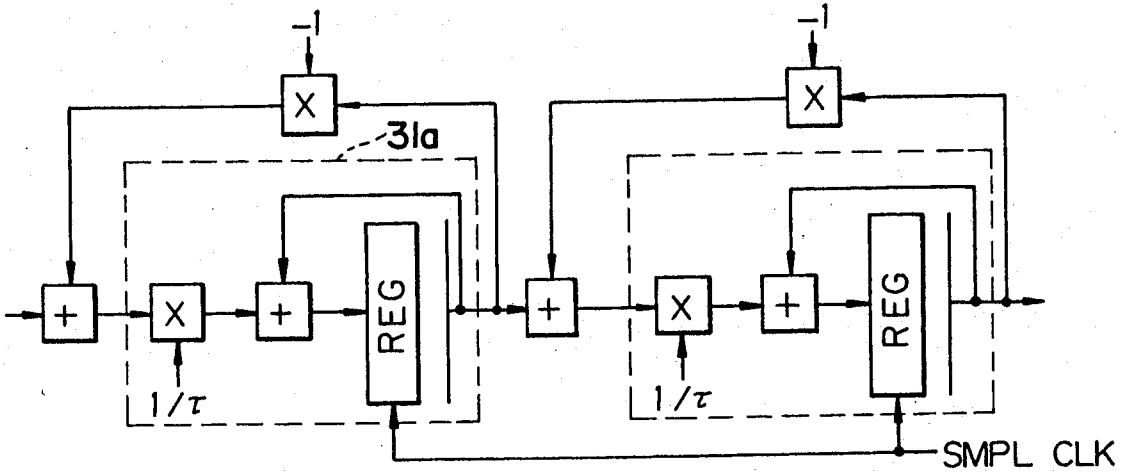
FIG. 24 is a detailed view of FIG. 23.

FIG. 24 shows FIG. 23 in more detail.

Figure 25:
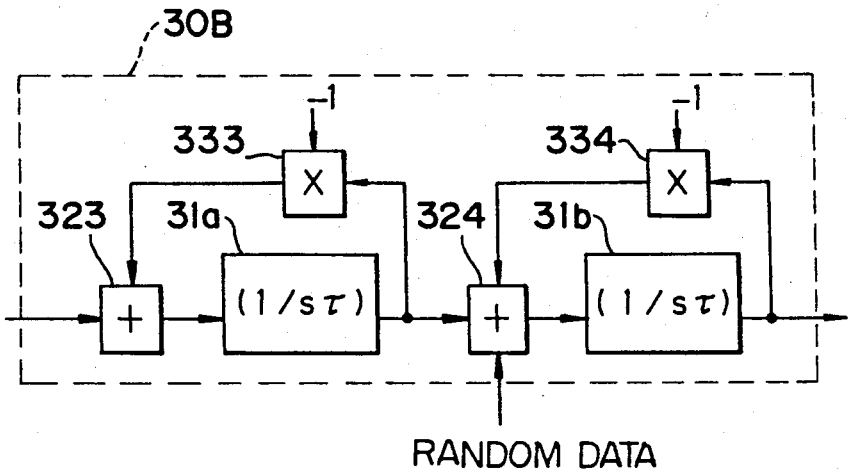
FIG. 25 is a diagram of a critical damping two-order filter used in a modulation incorporation method in the present invention.
Figure 26:
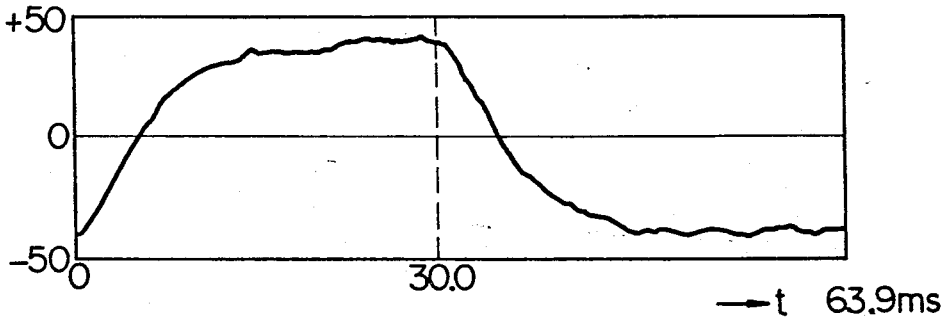
FIG. 26 is a graph of the step response of the critical damping two-order filter used in the modulation incorporation method of FIG. 25.
Figure 27:
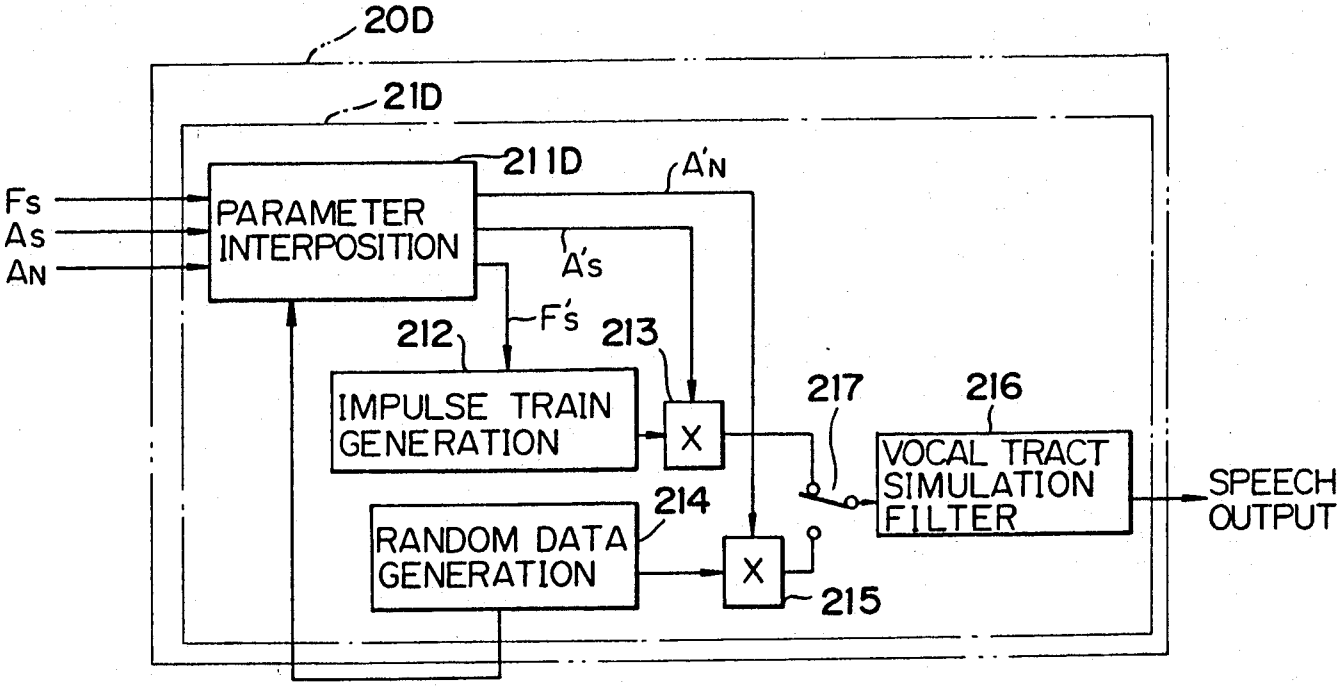
FIG. 27 is a diagram of a speech synthesis apparatus of the present invention.

Referring to FIG. 25 to FIG. 27, an explanation will be made with respect to a fourth method of modulation incorporation. The fourth modulation incorporation method, unlike the first through third modulation incorporation methods, adds a random number of time series to the first-order delay filter connector forming the critical damping two-order filter and produces modulated interpolation parameters.

FIG. 25 is a critical damping two-order filter 30B which is comprised of a two stage series connection of first-order delay filters and which has a construction the same as the critical damping two-order filter 30B of FIG. 23. Corresponding parts bear corresponding reference numerals. That is, 31*a* and 31*b* are integrators, 323 and 324 are adders, and 333 and 334 are multipliers with multiplication constants of $-1$. If a random number time series is added to the adder 324, corresponding to the connector of the two first-order delay filters, modulated interpolation parameters will be produced.

FIG. 26 shows the step response characteristics obtained by the fourth modulation incorporation method of the circuit in FIG. 25. The step changes can be smoothly interpolated as shown in the figure and it is possible to produce modulated interpolation parameters corresponding to the modulation time series signal.

FIG. 27 is a block diagram of a specific construction of a circuit for performing the fourth modulation incorporation method. The construction of the speech synthesis means 20D is the same as that of FIG. 10 with the exception that the parameter interpolator 211D of the speech synthesizer 21D is constructed by the critical damping two-order filter 30B of FIG. 25. The operation of the fourth modulation incorporation method of FIG. 27 is clear from FIG. 24 and the explanation of the operation of the various modulation incorporation methods, so the explanation will be omitted.

As clear from the explanation up to now, the primary delay filter and the critical damping two-order filter both use as $1/s\tau(=\omega/s)$. Therefore, simplication of the construction of this integrator would enable simplification of the construction of the primary delay filter and the critical damping two-order filter.

In the present invention, approximation of the digital integration in the integrator by the simple Euler integration method simplifies the construction of the integrator. Below, an explanation will be made of the integrator construction method of the present invention with reference to FIG. 28.

Figure 28:
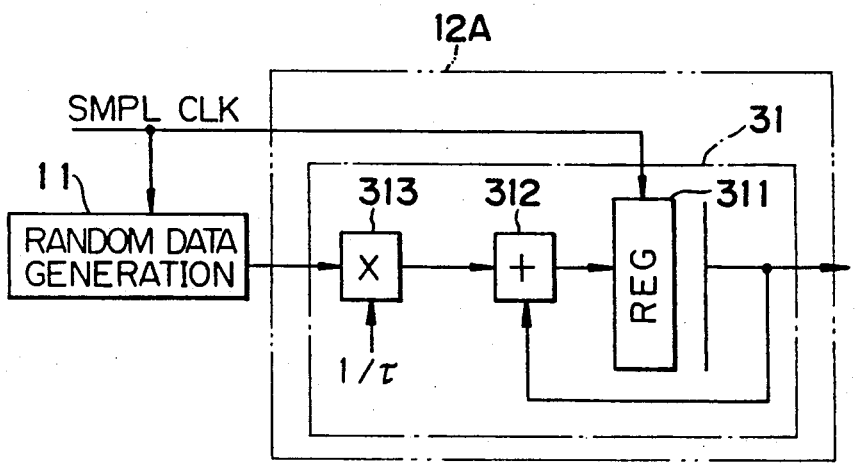
FIG. 28 is a diagram of an integrator of the present invention.

In FIG. 28, reference numeral 31 is an integrator comprised of a register 313, adder 312, and multiplier 313. The multiplier 313, adder 312, and register 311 are connected in series. The value of the register 311 at one point in time has added thereto an input value by the adder 312. The sum is used as the value of the register 311 at the next point of time. A timing clock for the generation of a random number time series is used for regulating the time. The multiplier 313 multiplies the inverse value of the time constant $\tau$, $(1/\tau-\omega)$ with the input and adds the result to the adder 312. If a power of 2 is selected as the value of the time constant $\tau$, then it is possible to replace this multiplication by a shift. In this case, the amount of the shift is always constant and can be realized by shifting the connecting line. No addition circuits (function components) are necessary, and thus the circuit is simplified. Integration processing approximated by the Euler integration method is performed and an integrator can be realized by a simple construction The primary delay filter may be realized by using the abovementioned integrator in FIG. 28 as the integrator 31 of the primary delay filter. Further, it is possible to construct a primary delay filter using other principles. Below, an explanation will be made of other methods for constructing primary delay filters with reference to FIG. 29 and FIG. 30.

Figure 29:
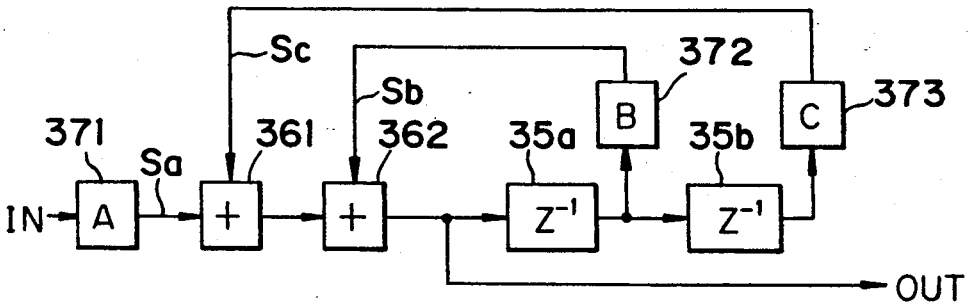
FIG. 29 is a diagram of a two-order filter of a two-order infinite impulse response (IIR) type of the present invention.

A typical speech synthesizer is described by Dr. Dennis H. Klatt in the *Journal of the Acoustic Society of America*, 67(3), March 1980, pp. 971–995, "Software for a Cascade/Parallel Format Synthesizer". The vocal tract characteristic simulation filter of the speech synthesizer, a shown in FIG. 29, uses 17 two-order unit filters. The two-order unit filter of FIG. 29 is a two-order infinite impulse response (IIR) digital filter. In FIG. 29, reference numeral 35 (35*a* and 35*b*) is a delay element with a sampling period of T, 361 and 362 are adders, 371, 372, and 373 are multipliers having constants A, B, and C. A signal Sa comprised of the input multiplied by the constant A by multiplier 371 is input into the delay element 35*a*, the output of the delay element 35*a* is input to the delay element 35*b*, and the sum of the three signals of the signal Sa comprised of the input multiplied by the constant A in the multiplier 371, the signal Sb comprised of the output of the delay element 35*a* multiplied by the constant B in the multiplier 372, and the signal Sc comprised of the output of the delay element 35*b* multiplied by the constant C in the multiplier 373 is output. The thus formed 17 two-order unit filters all have the same construction, but the multiplication constants A, B, and C differ with each of the individual unit filters. That is, by making the multiplication constants A, B, and C suitable values, the two-order unit filters may become bandpass filters or band elimination filters and various central frequencies may be obtained. The main part of the speech synthesizer is realized by a collection of filters having identical construction, so when realizing the same by software there is the advantage that common use may be made of a single subroutine, and when realizing the same by hardware, there is the advantage that development costs can be reduced by the use of a number of circuits having the same construction and ICs of the same construction.

The transfer function H(z) and the multiplication constants A, B and C when the two-order unit filter of FIG. 29 is used as a bandpass filter are given by the following equations in the above-mentioned article:

$$Hk(z)=A/(1-BZ^{-1}-CZ^{-2}) \tag{10}$$

$$C=-\exp(-2\pi\cdot BW\cdot T) \tag{11}$$

$$B=2\cdot\exp(-\pi\cdot BW\cdot T)\cos(2\pi\cdot f\cdot T) \tag{12}$$

$$A=1-B-C \tag{12}$$

Where,

T: sampling period

F: resonance frequency of the filter

BW: frequency bandwidth of the filter

In another method of construction of a first-order delay filter, it was discovered that by using the aforementioned two-order unit filter, a first-order delay filter using an integrator as described with respect to FIG. 28 can be constructed.

Figure 30:
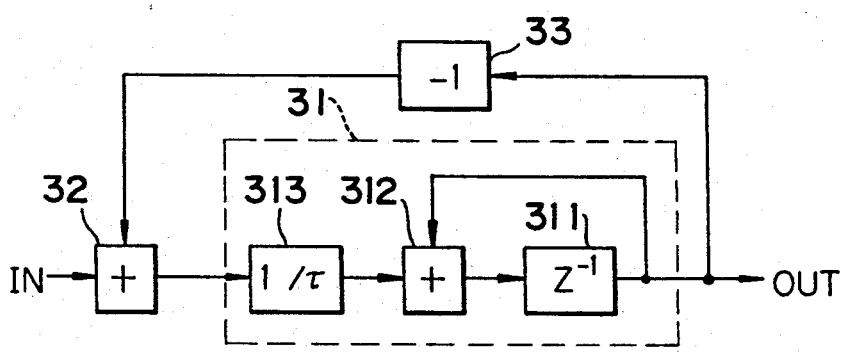
FIG. 30 is a diagram of a first-order delay filter using the IIR type filter of FIG. 29.

When constructing a first-order delay filter using an integrator 31 as shown in FIG. 28, the result is as shown in FIG. 30. In the figure, reference numeral 32 is an adder and 33 a multiplier. Here, the register 311 takes the input of a certain point of time and outputs it at the next point of time (that is, a sampling period) for reinput. This corresponds to the delay element 35 (35*a* and 35*b*) of the two-order unit filter of FIG. 21. Therefore, if the transfer function $H_1(z)$ of the primary delay filter in FIG. 30 is expressed using the same symbols as the transfer function Hk(z) of the two-order unit filter of FIG. 29, $H_1(z)$ would be expressed by the following equation (14) and could be further changed to equation (15):

$$H_1(z)=\frac{1/\tau}{1+1/\tau-Z^{-1}} \tag{14}$$

$$=\frac{1/(\tau+1)}{1-\{\tau/(1+\tau)\}Z^{-1}} \tag{15}$$

A comparison with the $Hk(z)=A(1-Bz^{-1}-Cz^{-2})$ of equation (10) gives the following equation (16):

$$A=\frac{1}{\tau+1},\ B=\frac{\tau}{\tau+1},\ C=0 \tag{16}$$

Using A, B, and C of equation (16), it is possible to construct a primary delay filter by a two-order IIR type filter.

Such a construction of a first-order delay filter can be used not only as a vocal tract filter of a speech synthesizer, but also as a first-order filter in the afore-mentioned modulation methods and critical damping two-order filter construction methods.

The third critical damping two-order filter construction method constructs a critical damping two-order filter using the above-mentioned two-order unit filter (two-order IIR filters) and integrator shown in FIG. 28. Below, an explanation will be given with respect to the third method of construction of the critical damping two-order filter with reference to FIG. 31.

The critical damping two-order filter is constructed by the above-mentioned equation (9) and the two stage series connection of first-order delay filters as shown in FIG. 23.

If the transfer function Hc(s) of the critical damping two-order filter of equation (9) is expressed using the same symbols as the transfer function Hk(z) of the two-order filter shown in equation (10) (shown by $H_2(z)$), equation (17) is obtained:

$$H_2(z) = \left\{ \frac{1/\tau}{1 + 1/\tau + Z^{-2}} \right\}^2 \tag{17}$$

$$= \frac{\{1/(\tau + 1)\}^2}{1 - \{(2\tau/(\tau + 1)\} \cdot Z^{-1} + \{\tau/(\tau + 1)\}^2 \cdot Z^{-2}}$$

A comparison of the $H_2(z)$ of equation (17) and the $Hk(z)=A/(1-Bz^{-1}-Cz^{-2})$ of equation (10) gives the following equation (18):

$$\left.\begin{aligned} A &= \{1/(\tau + 1)\}^2 = 1/(\tau^2 + 2\tau + 1) \\ B &= 2\tau/\tau + 1 \\ C &= \{\tau/(\tau + 1)\}^2 = \tau^2/(\tau^2 + 2\tau + 1) \end{aligned}\right\} \tag{18}$$

Figure 31:
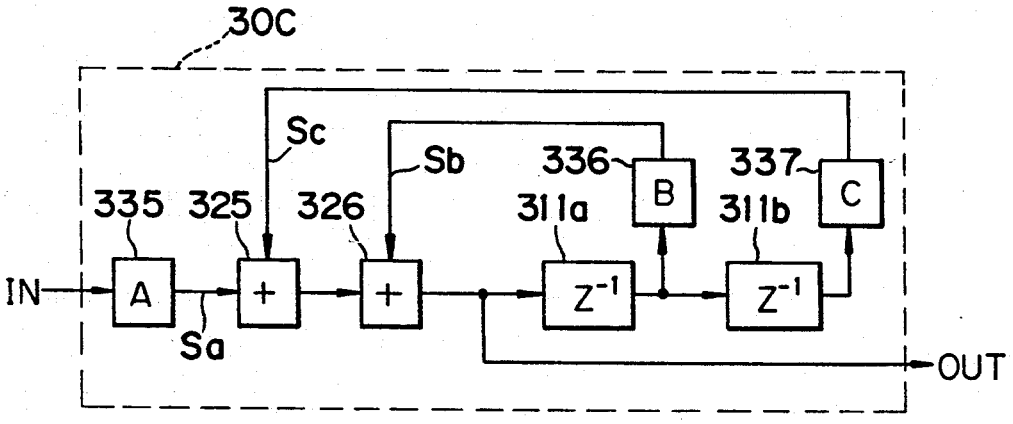
FIG. 31 is a diagram of a critical damping two-order filter according to the present invention.

Using A, B, and C of equation (18), it is possible to construct a critical damping two-order filter 30*c* by a two-order IIR type filter as shown in FIG. 31. In the critical damping two-order filter 30*c* of FIG. 31, reference numeral 311 (311*a* and 311*b*) is a register and 325 and 326are adders. Reference numerals 335, 336, and 337 are multipliers for multiplying the constants A, B and C of equation (18).

As explained above, according to the various aspects of the present invention, the following advantages are obtained:

(a) Since modulation is fully digital, it is possible to synthesize speech having stable modulation characteristics.

(b) Since modulation is given to the speech output based on a modulation time series signal obtained by random time series integration filter, it is possible to synthesize speech very naturally.

(c) The critical damping two-order filter which performs the parameter interpolation during the speech synthesis can be constructed very simply using digital filters.

(d) When using a critical damping two-order filter, smooth connection of parameters is possible, so together with the above (b) it is possible to obtain a very natural synthesized speech.

Many widely different embodiments of the present invention may be constructed without departing from the spirit and scope of the present invention, and it should be understood that the present invention is not restricted to the specific embodiments described above, except as defined in the appended claims.

We claim:

1. A speech synthesizing system, comprising:

means for generating a vowel signal;

means for generating a consonant signal;

means for generating random data;

fluctuation data generating means, operatively connected to said random data generating means, for receiving random data from said means for generating random data, having a first-order delaying function for outputting fluctuation data, said fluctuation data generating means comprising:

first adding means having an input terminal and connected to said means for generating random data;

integral means, connected to said first adding means, for receiving an output from said first adding means and having an output terminal, said integral comprising:

multiplying means connected to said first adding means;

second adding means connected to said multiplying means and including an input terminal;

data holding means connected to said second adding means and having an input terminal; and feedback line means provided between the output terminal of said data holding means and the input terminal of said second adding means, said multiplying means multiplying the output from said first adding means of said fluctuation data generating means and a factor of $1/\tau$, where $\tau$ is a time constant, and said second adding means in said integral means adding the output from said multiplying means and the output from said data holding means through said feedback line means;

negative feedback means, connected between the output terminal of said integral means and the input terminal of said first adding means, for multiplying the output from said integral means and a coefficient and inverting a signal of the multiplied value, said first adding means adding random data from said random data generating means and the inverted multiplied value from said negative feedback means;

selecting means, connected to receive a selection signal, for selecting one of the vowel signal or the consonant signal in response to the selection signal; and means, operatively connected to said selecting means, for receiving an output signal from said selecting means and for filtering the received signal on the basis of a vocal tract simulation method, the fluctuation data from said fluctuation data generating means being substantially multiplied or added to one of the vowel signal or the consonant signal as determined by said selecting means.

2. A speech synthesizing system according to claim 1, wherein said coefficient is one.

3. A speech synthesizing system according to claim 1, wherein said vowel signal generating means and said consonant signal generating means comprise a common parameter interposing means for receiving a first signal having a sound frequency, a second signal having a voice amplitude and a third signal having a voiceless amplitude, and interposing the received first to third signals to output first to third interposed signals;

wherein said vowel signal generating means further comprises:

means for generating an impulse train signal in response to the first interposed signal;

means, connected to said impulse train signal generating means, for multiplying the impulse train signal and the second interposed signal, and for supplying a first multiplied signal to said selection means;

means for adding a constant as a bias and the first-order delayed random data from said first-order delaying means; and means, connected to said means for adding a constant, for multiplying an added signal from said means for adding a constant and the output from said vocal tract simulation filtering means and for outputting a speech signal having fluctuation components; and wherein said consonant signal generating means further comprises means for multiplying the random data output from said random data generation means and the third interposed signal to supply a second multiplied signal to said selection means.

4. A speech synthesizing system according to claim 3, wherein said common parameter interposing means comprises linear interposing means.

5. A speech synthesizing system according to claim 3, wherein said common parameter interposing means comprises:

first data holding means;

critical damping two-order filtering means connected in series with said first data holding means; and second data holding means connected in series with said critical damping two-order filtering means.

6. A speech synthesizing system according to claim 5, wherein said critical damping two-order filtering means comprises:

first and second adder means connected in series;

first integral means connected to said second adder means and having an output terminal;

first multiplying means, connected between the output terminal of said first integral means and an input terminal of said second adder means, for multiplying the output of said first integral means and a damping factor and inverting a sign of the multiplied value;

second integrator means connected to said first integrator means and having an output terminal; and second multiplying means, connected between the output terminal of said second integral means and an input terminal of said first adding means, for multiplying an output from said second integral means and a coefficient, and inverting a signal of the multiplied value, said first adding means adding an output from said first data holding means of said common parameter interposing means and the inverted multiplied value from said second multiplying means, and said second adding means adding an output from said first adding means and the inverted multiplied value from said first multiplying means.

7. A speech synthesizing system according to claim 6, wherein each of said first and second integral means comprises:

third multiplying means connected to said first adding means;

fourth adding means having an input terminal and connected to said third multiplying means;

data holding means having an output terminal and connected to said fourth adding means; and feedback line means provided between the output terminal of said data holding means and the input terminal of said fourth adding means, said third multiplying means multiplying the input signal and a factor $1/\tau$, where $\tau$ is a time constant, and said fourth adding means adding the output from said third multiplying means and the output from said data holding means through said feedback line means.

8. A speech synthesizing system according to claim 7, wherein the damping factor DF is two, and the coefficient is one.

9. A speech synthesizing system according to claim 5, wherein said critical damping two-order filtering means comprises:

first and second first-order delaying means connected in series, each including:

adding means having an input terminal;

integral means having an output terminal and connected to said adding means; and multiplying means provided between the output terminal of said integral means and the input terminal of said adding means, for multiplying an output of said adding means, for multiplying an output of said integral means and the coefficient and inverting the product, said adding means adding the input and the inverted-multiplied value from said multiplying means and supplying the sum to said integral means.

10. A speech synthesizing system according to claim 9, wherein said integral means comprises:

multiplying means;

adding means connected to said multiplying means and having an input-terminal;

data holding means connected to said adding means and having an output terminal; and feedback line means provided between the output terminal of said data holding means and the input terminal of said adding means, said multiplying means multiplying the input signal and a factor $1/\tau$, where $\tau$ is a time constant, and said adding means adding an output from said adding means and the output from said data holding means through said feedback line means.

11. A speech synthesizing system according to claim 10, wherein the coefficient is one.

12. A speech synthesizing system according to claim 1, further comprising means for adding a constant as a bias to the fluctuation data from said fluctuation data generating means;

wherein said vowel signal generating means and said consonant signal generating means comprise a common parameter interposing means for receiving a first signal having a sound frequency, a second signal having a voice amplitude and a third signal having a voiceless amplitude, and interposing the received first to third signals to output first to third interposed signals;

wherein said vowel signal generating means further comprises:

first multiplying means, connected to said common parameter interposing means, for multiplying the first interposed signal and the added signal from said first adding means;

means, connected to said first multiplying means, for generating an impulse train signal in response to the multiplied signal from said first multiplying means;

second multiplying means, connected to said common parameter interposing means, for multiplying the second interposed signal and the added signal from said first adding means; and third multiplying means, connected to said impulse train generating means and said second multiplying means, for multiplying the impulse train signal and the second multiplied signal from said second multiplying means and for outputting the multiplied signal to said selection means; and wherein said constant signal generating means further comprises:

fourth multiplying means, connected to said first adding means, for multiplying the added signal from said first adding means and the third interposed signal; and fifth multiplying means, connected to said random data generating means, for multiplying the random signal from said random data generating means and the fifth multiplied signal from said fifth multiplying means to supply the fifth multiplied signal to said selection means.

13. A speech synthesizing system according to claim 12, wherein the common parameter interposing means comprises linear interposing means.

14. A speech synthesizing system according to claim 12, wherein the common parameter interposing means comprises series-connected first data holding means, critical damping two-order filtering means and second data holding means.

15. A speech synthesizing system according to claim 1, wherein said vowel signal generating means and said consonant signal generating means comprise a common parameter interposing means for receiving a first signal having a sound frequency, a second signal having a voice amplitude and a third signal having a voiceless amplitude, and interposing the received first to third signals to output first to third interposing signals;

wherein said vowel signal generating means further comprises:

first adding means, connected to said first-order delaying means and said common parameter interposing means, for adding the first interposed signal and the fluctuation data from said fluctuation data generating means;

means, connected to said first adding means, for generating an impulse train signal in response to the first added signal from said first adding means;

second adding means, connected to said common parameter interposing means and said fluctuation data generating means, for adding the second interposed signal and the first-order delayed signal; and first multiplying mans, connected to said impulse train generating means and said second adding means, for multiplying the impulse train signal and the second added signal from said second adding means, and for outputting the first multiplied signal to said selection means; and wherein said consonant signal generating means further comprises:

third adding means, connected to said common parameter interposing means and said fluctuation data generating means, for adding the third interposed signal and the first-order delayed signal; and second multiplying means, connected to said random data generating means and said third adding means, for multiplying the random data from said random data generating means and the third added signal from said third adding means, and for outputting the second multiplied signal to said selection means.

16. A speech synthesizing system according to claim 15, wherein the common parameter interposing means comprises linear interposing means.

17. A speech synthesizing system according to claim 15, wherein the common parameter interposing means comprises series-connected first data holding means, critical damping two-order filtering means and second data holding means.

18. A speech synthesizing system comprising:

parameter interpolating means;

impulse train generating means having an input and an output terminal and connected to said parameter interpolating means;

random data generating means, connected to said parameter interpolating means, for generating random data and having an output terminal;

selection means having two input terminals and an output terminal, for generating a selection signal for selecting one of said impulse train generating means and said random data generating means;

first multiplying means connected between the output terminal of said impulse train generating means and a first one of the input terminals of said selection means;

second multiplying means connected between the output terminal of said random data generation means and a second one of the input terminals of said selection means; and means, connected to the output terminal of said selection means, for filtering an output from said selection means on the basis of a vocal tract simulation method, said parameter interpolating means including:

critical damping two-order filtering means, operatively connected to said random data generating means, for receiving the random data from said random data generating means, and for interpolating a first signal having a sound frequency, a second signal having a sound amplitude and a third signal having a silent amplitude by multiplying the random data with the first, second and third signals and by filtering the first through third multiplied data using a critical damping two-order filtering method, to output the first through third interpolated signals, said impulse train generating means generating impulse trains in response to the first interpolated signal, said first multiplying means multiplying the impulse trains and the second interpolated signal and outputting a vowel signal to the first one of the input terminals of said selection means;

said second multiplying means multiplying the random data and the third interpolated signal and outputting a consonant signal to the second one of the input terminals of said selection means; and said selection means selecting one of the vowel signal and consonant signal, and outputting a selected signal to said vocal tract simulation filtering means.

19. A speech synthesizing system according to claim 18, wherein said critical damping two-order means in said parameter interpolating means comprises:

first multiplying means for multiplying the input and a first coefficient;

first adding means, connected to said first multiplying means and having an input terminal;

second adding means, connected to said first adding means and having an output terminal;

first integral means, connected to the out put terminal of said second adding means, and having an output terminal;

second multiplying means, connected between the output terminal of said first integral means and the input terminal of said second adding means for multiplying an output of said first integral means and a second coefficient and for outputting the product to said second adding means;

second integral means, connected to the output terminal of said first integral means and having an output terminal; and third multiplying means, provided between the output terminal of said second integral means and the input terminal of said first adding means and for multiplying an output from said second integral means and a third coefficient, said first adding means adding an output from said first multiplying means and an output from said third multiplying means, and said second adding means adding an output from said first adding means and an output from said second multiplying means, and outputting the interpolated signals.

20. A speech synthesizing system according to claim 19, wherein each of said first and second integral means comprises:

multiplying means;

adding means connected to said multiplying means and having an input terminal;

data holding means connected to said adding means and having an output terminal; and feedback line means provided between the output terminal of said data holding means and the input terminal of said adding means, said multiplying means multiplying the input and a factor $1/\tau$, where $\tau$ is a time constant, and said adding means adding the output from said multiplying means and the output from said data holding means through said feedback line means.

21. A speech synthesizing system according to claim 20, wherein the damping factor DF is two, and the coefficient is one.

22. A speech synthesizing system according to claim 19, wherein each of said first and second integral means comprises:

a first adder connected to receive the input;

first multiplying means connected to said first adder;

a second adder connected to said first multiplying means;

a delay element connected to said second adder;

a feedback line connected between an output terminal of said delay element and the input of said second adder; and second multiplying means connected between the output terminal of said delay element and said first adder.

* * * * *

UNITED STATES PATENT AND TRADEMARK OFFICE

CERTIFICATE OF CORRECTION

PATENT NO. : 5,007,095

DATED : APRIL 9, 1991

INVENTOR(S) : YASUHIRO NARA ET AL.

It is certified that error appears in the above-identified patent and that said Letters Patent is hereby corrected as shown below:

TITLE PAGE, Col. 2, after line 11, insert the following:

--"Software for a Cascade/Parallel Format Synthesizer", D.H. Klatt, *J. Acoust. Soc. Am.* 67(3), March 1980, p. 971-995.--.

Col. 1, line 27, "Synthesis," should be --synthesis--.

Col. 7, line 64, "HC(s)" should be --Hc(s)--;
line 65, "filer" should be --filter--.

Col. 8, line 42, "f(tP" should be --f(t)P--.

Col. 10, line 49, "$1/s\tau+\alpha)$," should be --$1/(s\tau+\alpha)$,--.

Col. 12, line 68, "F's Therefore" should be --F's. Therefore--.

Col. 15, line 68, "311a and and 311b" should be --311a and 311b--.

Col. 16, line 15, "(4)" should be --(9)--.

UNITED STATES PATENT AND TRADEMARK OFFICE

CERTIFICATE OF CORRECTION

PATENT NO. : 5,007,095

DATED : APRIL 9, 1991

INVENTOR(S) : YASUHIRO NARA ET AL.

It is certified that error appears in the above-identified patent and that said Letters Patent is hereby corrected as shown below:

Col. 17, line 16, "use as" should be --use as constituent elements, an integrator having a transfer function of--;
line 35, "$\tau$, $(1/\tau-\omega)$" should be --$\tau(1/\tau-\omega)$--;
line 45, "construction" should be --construction.--;
line 58, "a shown" should be --as shown--.

Col. 18, line 31, "A=1-B-C (12)" should be --A=1-B-C (13)--.

Col. 25, line 16, "out put" should be --output--.

Signed and Sealed this

Twenty-third Day of February, 1993

*Attest:*

STEPHEN G. KUNIN

*Attesting Officer*

*Acting Commissioner of Patents and Trademarks*